US008676114B2

(12) United States Patent
Dillon et al.

(10) Patent No.: US 8,676,114 B2
(45) Date of Patent: Mar. 18, 2014

(54) DIGITAL RADIO BROADCAST RECEIVER, BROADCASTING METHODS AND METHODS FOR TAGGING CONTENT OF INTEREST

(71) Applicant: iBiquity Digital Corporation, Columbia, MD (US)

(72) Inventors: Robert Michael Dillon, Basking Ridge, NJ (US); Harvey Chalmers, Rockville, MD (US); Rodney Bernard Burke, Catonsville, MD (US); Joseph F D'Angelo, Bedminster, NJ (US)

(73) Assignee: iBiquity Digital Corporation, Columbia, MD (US)

( * ) Notice: Subject to any disclaimer, the term of this patent is extended or adjusted under 35 U.S.C. 154(b) by 0 days.

(21) Appl. No.: 13/725,284

(22) Filed: Dec. 21, 2012

(65) Prior Publication Data

US 2013/0109296 A1 May 2, 2013

Related U.S. Application Data

(62) Division of application No. 11/896,565, filed on Sep. 4, 2007, now Pat. No. 8,351,843.

(51) Int. Cl.
*H04H 40/00* (2008.01)

(52) U.S. Cl.
USPC ..... 455/3.06; 455/3.01; 455/3.02; 455/3.03; 455/3.04; 455/3.05

(58) Field of Classification Search
USPC ..... 455/3.01–3.05
See application file for complete search history.

(56) References Cited

U.S. PATENT DOCUMENTS

| | | | |
|---|---|---|---|
| 6,374,177 | B1 | 4/2002 | Lee et al. |
| 6,650,543 | B2 | 11/2003 | Lai et al. |
| 6,697,608 | B2 | 2/2004 | King-Smith |
| 6,721,337 | B1 | 4/2004 | Kroeger et al. |

(Continued)

FOREIGN PATENT DOCUMENTS

| | | |
|---|---|---|
| CN | 1494711 | 5/2004 |
| GB | 2361611 | 10/2001 |
| WO | 02063599 | 8/2002 |

OTHER PUBLICATIONS

International Search Report dated Nov. 26, 2008 from PCT/US2008/010338.

(Continued)

*Primary Examiner* — Fayyaz Alam
(74) *Attorney, Agent, or Firm* — Jones Day

(57) ABSTRACT

A method for specifying content of interest using a digital radio broadcast receiver is described. A digital radio broadcast signal includes first audio content and first program data, wherein the first program data includes information identifying a first item, and includes second audio content and second program data, wherein the second program data includes information identifying a second item. A user command entered at a user interface during reception of audio content is registered, indicating a user's interest in either the first or second audio content. It is determined whether there is an ambiguity in the content of interest. If there is an ambiguity, a first data structure is stored for the first audio content, and a second data structure is stored for the second audio content. The first data structure includes the information identifying the first item, and the second data structure includes the information identifying the second item.

15 Claims, 23 Drawing Sheets

(56) References Cited

U.S. PATENT DOCUMENTS

| | | | | |
|---|---|---|---|---|
| 6,829,368 | B2 * | 12/2004 | Meyer et al. | 382/100 |
| 6,915,176 | B2 | 7/2005 | Novelli et al. | |
| 6,925,489 | B1 | 8/2005 | Curtin | |
| 6,957,041 | B2 | 10/2005 | Christensen et al. | |
| 6,964,023 | B2 * | 11/2005 | Maes et al. | 715/811 |
| 7,010,263 | B1 | 3/2006 | Patsiokas | |
| 7,107,234 | B2 | 9/2006 | Deguchi | |
| 7,127,454 | B2 | 10/2006 | Deguchi | |
| 7,231,270 | B2 | 6/2007 | Kamdan et al. | |
| 8,351,843 | B2 | 1/2013 | Dillon et al. | |
| 2002/0010641 | A1 | 1/2002 | Stevens et al. | |
| 2002/0010652 | A1 | 1/2002 | Deguchi | |
| 2002/0023096 | A1 | 2/2002 | Deguchi | |
| 2002/0095228 | A1 | 7/2002 | Corts et al. | |
| 2002/0145589 | A1 | 10/2002 | Tree | |
| 2002/0145943 | A1 | 10/2002 | Tree | |
| 2002/0147762 | A1 | 10/2002 | Tree | |
| 2003/0084108 | A1 | 5/2003 | Syed | |
| 2003/0093476 | A1 * | 5/2003 | Syed | 709/204 |
| 2003/0236711 | A1 * | 12/2003 | Deguchi | 705/26 |
| 2004/0002938 | A1 | 1/2004 | Deguchi | |
| 2004/0003150 | A1 | 1/2004 | Deguchi | |
| 2005/0054286 | A1 * | 3/2005 | Kanjilal et al. | 455/3.05 |
| 2006/0019601 | A1 | 1/2006 | Kroeger et al. | |
| 2006/0053079 | A1 | 3/2006 | Edmonson et al. | |
| 2006/0069718 | A1 | 3/2006 | Hirayama | |
| 2006/0128418 | A1 | 6/2006 | Quelle et al. | |
| 2006/0209941 | A1 | 9/2006 | Kroeger | |
| 2006/0235864 | A1 | 10/2006 | Hotelling et al. | |
| 2008/0090513 | A1 | 4/2008 | Collins et al. | |
| 2008/0130686 | A1 | 6/2008 | Milbar | |
| 2008/0183757 | A1 | 7/2008 | Dorogusker et al. | |
| 2008/0188209 | A1 * | 8/2008 | Dorogusker et al. | 455/414.2 |
| 2008/0298440 | A1 * | 12/2008 | Kroeger et al. | 375/150 |
| 2009/0028192 | A1 | 1/2009 | Rieger et al. | |
| 2009/0104870 | A1 * | 4/2009 | Christensen et al. | 455/3.01 |
| 2009/0104872 | A1 * | 4/2009 | Christensen et al. | 455/3.06 |
| 2010/0009622 | A1 | 1/2010 | Chen | |
| 2011/0090897 | A1 | 4/2011 | Johnson et al. | |

OTHER PUBLICATIONS

Written Opinion of the International Searching Authority dated Nov. 26, 2008 from PCT/US2008/010338.

iTag, You're It: From Free PCs to Free Media Companies, Michael Dortch, Apr. 28, 2000, retrieved from the Internet at http://siliconvalley.internet.com/news/article.php/3531-351001 on Aug. 23, 2007.

Xenote Shuts Down Innovative Music Service, David Needle, Sep. 21, 2000, retrieved from the Internet at http://siliconvalley.internet.com/news/print.php/466421 on Aug. 23, 2007.

International Search Report dated Oct. 6, 2010 from PCT/US2010/044090 corresponding to U.S. Appl. No. 12/805,469.

Written Opinion of the International Searching Authority dated Oct. 6, 2010 from PCT/US2010/044090 corresponding to U.S. Appl. No. 12/805,469.

Concise statement of relevance for CN 1494711A—See English translation of Office Action dated Jun. 24, 2011, containing Examiner's allegations in corresponding Chinese Patent Appl. No. 200880113807.9.

* cited by examiner

SCREEN DISPLAY (e.g., PC, mobile telephone, PDA)

SCREEN DISPLAY (e.g., PC, mobile telephone, wireless PDA, etc.)

| Field | Length | Data Type |
|---|---|---|
| Header | 10 Bytes | Binary – first 4 bytes contain 'UFID' |
| Frame Type | x bytes | Character |
| Delimiter | 1 byte | Character |
| Format | y bytes | Character |
| Text String | Variable | Null-terminated Character String |
| ID Data | Variable | Depends on 'Format' |

FIG. 15

Audio Purchase UFID Format with One ID

| APC Format Code | Description |
|---|---|
| 'MC' | Indicates that the identifier field contains multiple IDs |
| '00' | Invalid – do not use |
| '01' | Identifier Type 1 |
| '02' | Identifier Type 2 |
| '03' | Identifier Type 3 |
| '04' | Identifier Type 4 |
| '05' | Identifier Type 5 |
| '06' | Identifier Type 6 |
| '07' | Reserved |
| Any other pair of character codes | Reserved |

FIG. 17

Audio Purchase UFID Format with Multiple IDs

UFID Information Hierarchy

| FIELD # | FIELD | SOURCE | OFFSET | SIZE | FIELD TYPE |
|---|---|---|---|---|---|
| 1 | Metadata Type (0x00 for standard) | n/a | 0x000 | 1 | core |
| 2 | Country Code / FCC Facility ID (USA only) | SIS | 0x001 | 4 | core |
| 3 | Title (0x00 terminated) | PSD | 0x005 | 64 | core |
| 4 | Artist (0x00 terminated) | PSD | 0x045 | 64 | core |
| 5 | Album (0x00 terminated) | PSD | 0x085 | 64 | core |
| 6 | UFID URL (0x00 terminated) | PSD | 0x0C5 | 128 | core |
| 7 | UFID DATA (binary data) | PSD | 0x145 | 64 | core |
| 8 | Short Station Name (call sign) | SIS | 0x185 | 9 | core |
| 9 | Universal Short Station Name | SIS | 0x18E | 56 | optional |
| 10 | ALFN (time stamp) | SIS | 0x1C6 | 4 | optional |
| 11 | Time Lock Status | SIS | 0x1CA | 1 | optional |
| 12 | Station Frequency (as text, e.g., 100.35 FM, right justified) | RECEIVER | 0x1CB | 9 | optional |
| 13 | Stream Identifier (0x01, 0x02, etc.) | RECEIVER | 0x1D4 | 1 | optional |
| 14 | Date (MM/DD/YY, BCD format) | RECEIVER | 0x1D5 | 3 | core |
| 15 | Time of Day (HH:MM:SS, 24-hour, BCD format) | RECEIVER | 0x1D8 | 3 | core |
| 16 | Signal Strength (0x01 to 0xFF) | RECEIVER | 0x1DB | 1 | optional |
| 17 | Genre (0x00 terminated) | PSD | 0x1DC | 32 | core |
| 18 | Ambiguous Data Flag (0x01 = ambiguous) | RECEIVER | 0x1FC | 1 | core |
| 19 | Data From User Command (e.g., button press) (0x01 = yes) | RECEIVER | 0x1FD | 1 | core |
| 20 | RESERVED (future use) | n/a | 0x1FE | 2 | n/a |

FIG. 22

DIGITAL RADIO BROADCAST RECEIVER, BROADCASTING METHODS AND METHODS FOR TAGGING CONTENT OF INTEREST

This application is a divisional application of U.S. patent application Ser. No. 11/896,565, filed Sep. 4, 2007, the entire contents of which are incorporated herein by reference.

FIELD OF THE INVENTION

This invention relates to digital radio broadcasting receivers, and more particularly to methods and apparatus for receiving digital radio broadcast content and for collecting information pertaining to the content and tagging content of interest.

BACKGROUND

Digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. HD Radio™ technology, developed by iBiquity Digital Corporation, is one example of an IBOC implementation for digital radio broadcasting and reception.

IBOC DAB signals can be transmitted in a hybrid format including an analog modulated carrier in combination with a plurality of digitally modulated carriers or in an all-digital format wherein the analog modulated carrier is not used. Using the hybrid mode, broadcasters may continue to transmit analog AM and FM simultaneously with higher-quality and more robust digital signals, allowing themselves and their listeners to convert from analog-to-digital radio while maintaining their current frequency allocations.

One feature of digital transmission systems is the inherent ability to simultaneously transmit both digitized audio and data. Thus the technology also allows for wireless data services from AM and FM radio stations. The broadcast signals can include metadata, such as the artist, song title, or station call letters. Special messages about events, traffic, and weather can also be included. For example, traffic information, weather forecasts, news, and sports scores can all be scrolled across a radio receiver's display while the user listens to a radio station.

IBOC DAB technology can provide digital quality audio, superior to existing analog broadcasting formats. Because each IBOC DAB signal is transmitted within the spectral mask of an existing AM or FM channel allocation, it requires no new spectral allocations. IBOC DAB promotes economy of spectrum while enabling broadcasters to supply digital quality audio to the present base of listeners.

Multicasting, the ability to deliver several programs or data streams over one channel in the AM or FM spectrum, enables stations to broadcast multiple streams of data on separate supplemental or sub-channels of the main frequency. For example, multiple streams of data can include alternative music formats, local traffic, weather, news, and sports. The supplemental channels can be accessed in the same manner as the traditional station frequency using tuning or seeking functions. For example, if the analog modulated signal is centered at 94.1 MHz, the same broadcast in IBOC DAB can include supplemental channels 94.1-1, 94.1-2, and 94.1-3. Highly specialized programming on supplemental channels can be delivered to tightly targeted audiences, creating more opportunities for advertisers to integrate their brand with program content. As used herein, multicasting includes the transmission of one or more programs in a single digital radio broadcasting channel or on a single digital radio broadcasting signal. Multicast content can include a main program service (MPS), supplemental program services (SPS), program service data (PSD), and/or other broadcast data.

The National Radio Systems Committee, a standard-setting organization sponsored by the National Association of Broadcasters and the Consumer Electronics Association, adopted an IBOC standard, designated NRSC-5A, in September 2005. NRSC-5A, the disclosure of which is incorporated herein by reference, sets forth the requirements for broadcasting digital audio and ancillary data over AM and FM broadcast channels. The standard and its reference documents contain detailed explanations of the RF/transmission subsystem and the transport and service multiplex subsystems. Copies of the standard can be obtained from the NRSC at http://www.nrscstandards.org/standards.asp. iBiquity's HD Radio™ technology is an implementation of the NRSC-5A IBOC standard. Further information regarding HD Radio™ technology can be found at www.hdradio.com and www.ibiquity.com.

Other types of digital radio broadcasting systems include satellite systems such as XM Radio, Sirius and WorldSpace, and terrestrial systems such as Digital Radio Mondiale (DRM), Eureka 147 (branded as DAB), DAB Version 2, and FMeXtra. As used herein, the phrase "digital radio broadcasting" encompasses digital audio broadcasting including in-band on-channel broadcasting, as well as other digital terrestrial broadcasting and satellite broadcasting.

Various approaches have been proposed for purchasing an item of interest by entering a command at a radio broadcast receiver based on digital data and content received with the receiver. For example, U.S. Pat. No. 6,925,489 describes an approach in which identification information is extracted from a current broadcast of a piece of music or other type of information of interest to a user using a digital audio broadcast receiver in response to a user command and stored in a memory or other storage device. The extracted information is then later delivered over a network connection to a server which permits the user to purchase the corresponding item U.S. Pat. No. 6,957,041 describes an approach in which a listener can respond to items in a radio broadcast such as music, advertisements, fund raising drives, or interactive listener polls during the broadcast, wherein data such as song title and artist, author or publisher, and IP address for the location of the digital content is transmitted using the RBDS/RDS data stream. Purchase requests can then be transmitted via wireless transmission or by accessing the Internet using a personal computer or wireless phone. U.S. Pat. No. 7,010,263 describes an approach in which a satellite radio receiver accepts user input identifying interest in music or data being played and/or displayed such that an ID signal is stored on removable media identifying the selection being played and/or displayed. The user can then download or place an order for the desired selection from a web site.

The present inventors have observed that ambiguities can arise in specifying which item is actually desired in response to a user command entered at a digital radio broadcast receiver equipped to record a user's interest in a desired item related to the received broadcast. It would be desirable to easily resolve such ambiguities and to provide a satisfying user experience in correctly specifying an item of interest in response to a user command entered at a digital radio broadcast receiver.

SUMMARY

According to an exemplary embodiment, a method for specifying content of interest using a digital radio broadcast receiver is described. A digital radio broadcast signal is received, wherein the digital radio broadcast signal comprises first audio content and first program data, the first program data comprising information identifying a first item associated with the first audio content. The digital radio broadcast signal also comprises second audio content and second program data, the second program data comprising information identifying a second item associated with the second audio content, the second audio content being received after the first audio content. A user command entered at a user interface of the receiver during reception of either the first audio content or the second audio content is registered by the receiver, the user command indicating a user's interest in either the first audio content or the second audio content, respectively. A determination as to whether there is an ambiguity associated with the user's interest in either the first audio content or the second audio content, and if there is an ambiguity, a first data structure corresponding to the first audio content is stored, and a second data structure corresponding to the second audio content is stored. The first data structure comprises the information identifying the first item and the second data structure comprising the information identifying the second item.

According to another exemplary embodiment a digital radio broadcast receiver comprises a processing system, a memory coupled to the processing system and an interface for receiving user command entered thereto, wherein the processing system is configured to carry out the above-described method.

According to another exemplary embodiment, a method of broadcasting digital radio broadcast data formatted to facilitate specifying content of interest using a digital radio broadcast receiver can be carried out using any suitable broadcasting equipment. The method comprises arranging first audio content and second audio content for broadcast via a digital radio broadcast signal. The method also comprises structuring first program data associated with the first audio content, such that the first program data comprise a first Unique File Identifier (UFID) frame comprising a first type code specifying a type of a first item associated with the first audio content, a first ID code identifying the first item, and a first Uniform Resource Locator (URL) address for obtaining information about the first item. The method also comprises structuring the second program data such that the second program data comprise a second Unique File Identifier (UFID) frame comprising a second type code specifying a type of a second item associated with the second audio content, a second ID code identifying the second item, and a second Uniform Resource Locator (URL) address for obtaining information about the second item. The method also comprises generating a digital radio broadcast signal comprising the first and second audio content and the first and second program data and transmitting the digital radio broadcast signal.

BRIEF DESCRIPTION OF THE DRAWINGS

FIG. 15 illustrates a table that describes various fields of the UFID illustrated in FIG. 14 according to one example.

FIG. 17 illustrates a table describing various types of Audio Purchase Codes (APC) according to one example.

FIG. 22 illustrates a table describing the field format of an exemplary purchase token as an example of a data structure.

DETAILED DESCRIPTION OF EXEMPLARY EMBODIMENTS

FIGS. 1-10 and the accompanying description herein provide a description of an exemplary IBOC system, including broadcasting equipment structure and operation, exemplary receiver structure and operation including functionality for storing information in response to a user command to specify an item of interest related to a received digital radio broadcast, and the structure of IBOC DAB waveforms. FIGS. 11-23 and the accompanying description herein provide further description of exemplary structure and operation of a digital radio broadcast receiver for storing information regarding an item of interest in response to a user command, exemplary data formats at both the broadcast and receiver sides, and exemplary approaches for obtaining information about the item of interest via a network such as the Internet (e.g., for purchasing the item).

IBOC System and Waveforms

Figure 1:
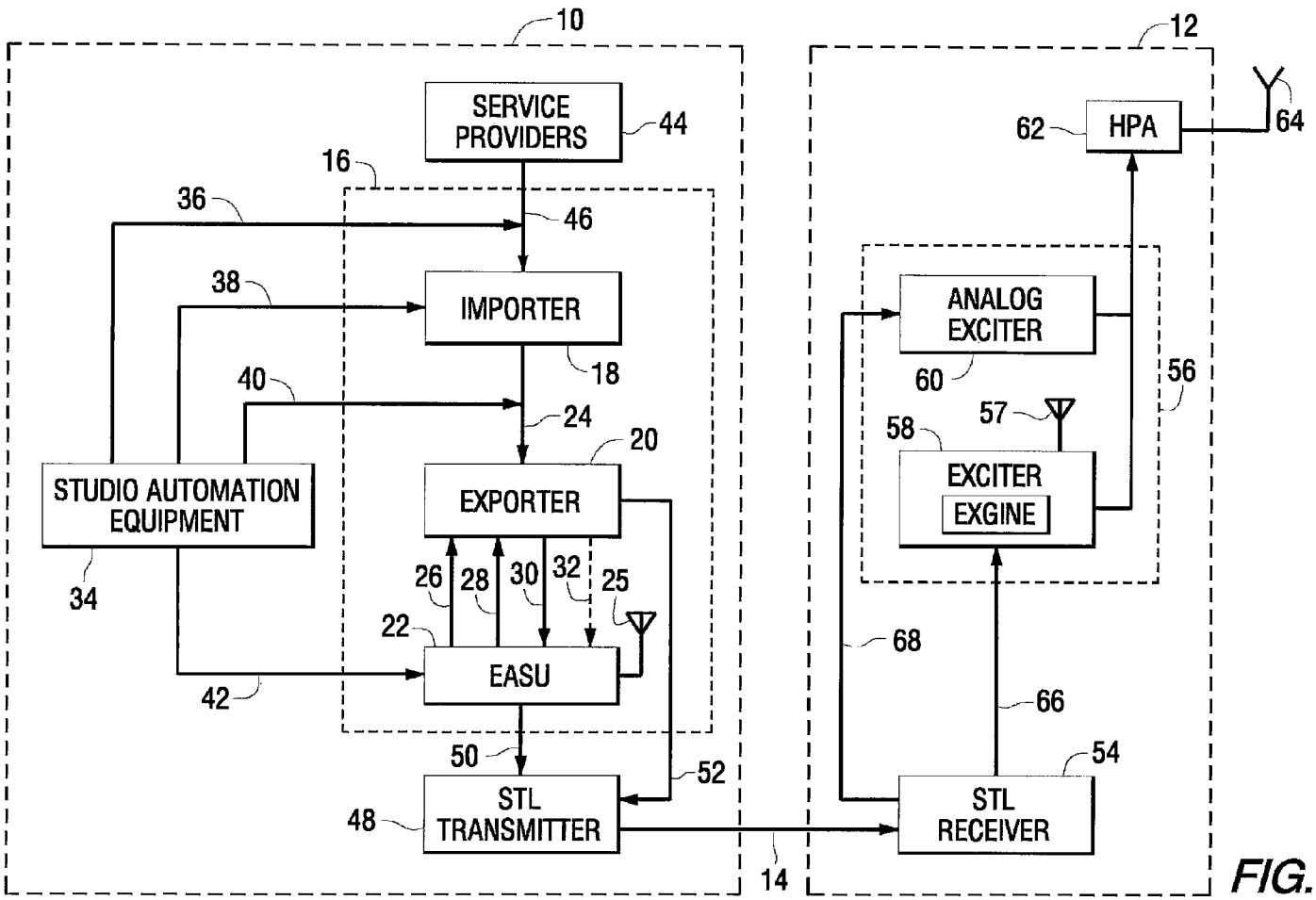
FIG. 1 is a block diagram of a transmitter for use in an in-band on-channel digital radio broadcasting system.

Referring to the drawings, FIG. 1 is a functional block diagram of the relevant components of a studio site 10, an FM transmitter site 12, and a studio transmitter link (STL) 14 that can be used to broadcast an FM IBOC DAB signal. The studio site includes, among other things, studio automation equipment 34, an Ensemble Operations Center (EOC) 16 that includes an importer 18, an exporter 20, an exciter auxiliary service unit (EASU) 22, and an STL transmitter 48. The transmitter site includes an STL receiver 54, a digital exciter 56 that includes an exciter engine (exgine) subsystem 58, and an analog exciter 60. While in FIG. 1 the exporter is resident at a radio station's studio site and the exciter is located at the transmission site, these elements may be co-located at the transmission site.

At the studio site, the studio automation equipment supplies main program service (MPS) audio 42 to the EASU, MPS data 40 to the exporter, supplemental program service (SPS) audio 38 to the importer, and SPS data 36 to the importer. MPS audio serves as the main audio programming source. In hybrid modes, it preserves the existing analog radio programming formats in both the analog and digital transmissions. MPS data, also known as program service data (PSD), includes information such as music title, artist, album name, etc. Supplemental program service can include supplementary audio content as well as program associated data.

The importer contains hardware and software for supplying advanced application services (AAS). A "service" is content that is delivered to users via an IBOC DAB broadcast, and AAS can include any type of data that is not classified as MPS, SPS, or Station Information Service (SIS). SIS provides station information, such as call sign, absolute time, position correlated to GPS, etc. Examples of AAS data include real-time traffic and weather information, navigation map updates or other images, electronic program guides, multimedia programming, other audio services, and other content. The content for AAS can be supplied by service providers 44, which provide service data 46 to the importer via an application program interface (API). The service providers may be a broadcaster located at the studio site or externally sourced third-party providers of services and content. The importer can establish session connections between multiple service providers. The importer encodes and multiplexes service data 46, SPS audio 38, and SPS data 36 to produce exporter link data 24, which is output to the exporter via a data link.

The exporter 20 contains the hardware and software necessary to supply the main program service and SIS for broadcasting. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC DAB broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment, rate converts it to the proper system clock, and outputs two copies of the signal, one digital (26) and one analog (28). The EASU includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bidirectional. The STL link may be a digital microwave or Ethernet link, for example, and may use the standard User Datagram Protocol or the standard TCP/IP.

The transmitter site includes an STL receiver 54, an exciter 56 and an analog exciter 60. The STL receiver 54 receives exciter link data, including audio and data signals as well as command and control messages, over the STL link 14. The exciter link data is passed to the exciter 56, which produces the IBOC DAB waveform. The exciter includes a host processor, digital up-converter, RF up-converter, and exgine subsystem 58. The exgine accepts exciter link data and modulates the digital portion of the IBOC DAB waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 includes a GPS unit and antenna 57. An alternative method for synchronizing the exporter and exciter clocks can be found in U.S. patent application Ser. No. 11/081,267 (Publication No. 2006/0209941 A1), the disclosure of which is hereby incorporated by reference. The RF up-converter of the exciter up-converts the analog signal to the proper in-band channel frequency. The up-converted signal is then passed to the high power amplifier 62 and antenna 64 for broadcast. In an AM transmission system, the exgine subsystem coherently adds the backup analog MPS audio to the digital waveform in the hybrid mode; thus, the AM transmission system does not include the analog exciter 60. In addition, the exciter 56 produces phase and magnitude information and the analog signal is output directly to the high power amplifier.

IBOC DAB signals can be transmitted in both AM and FM radio bands, using a variety of waveforms. The waveforms include an FM hybrid IBOC DAB waveform, an FM all-digital IBOC DAB waveform, an AM hybrid IBOC DAB waveform, and an AM all-digital IBOC DAB waveform.

Figure 2:
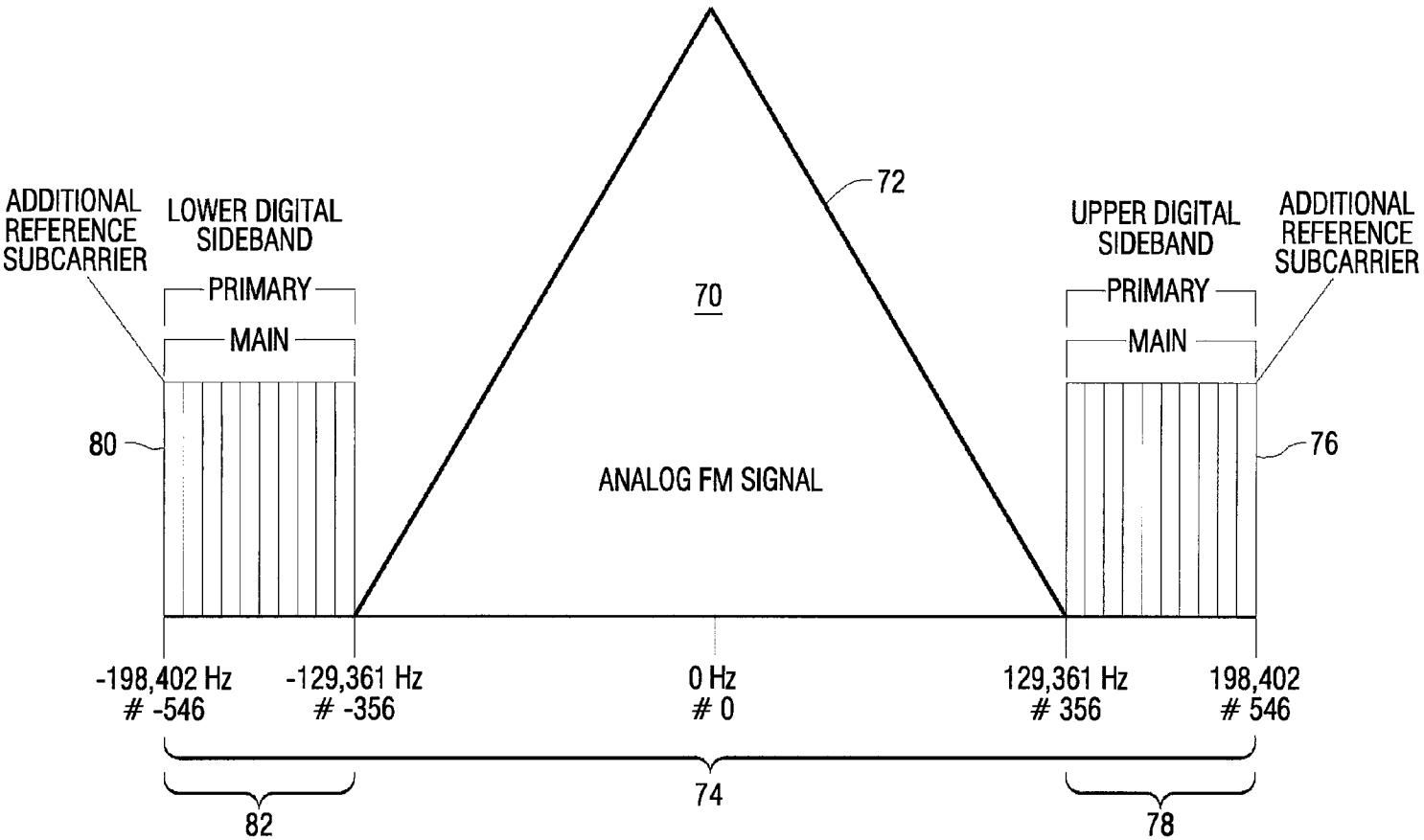
FIG. 2 is a schematic representation of a hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 OFDM subcarriers containing 18 data subcarriers and one reference subcarrier.

The hybrid waveform includes an analog FM-modulated signal, plus digitally modulated primary main subcarriers. The subcarriers are located at evenly spaced frequency locations. The subcarrier locations are numbered from −546 to +546. In the waveform of FIG. 2, the subcarriers are at locations +356 to +546 and −356 to −546. Each primary main sideband is comprised of ten frequency partitions. Subcarriers 546 and −546, also included in the primary main sidebands, are additional reference subcarriers. The amplitude of each subcarrier can be scaled by an amplitude scale factor.

Figure 3:
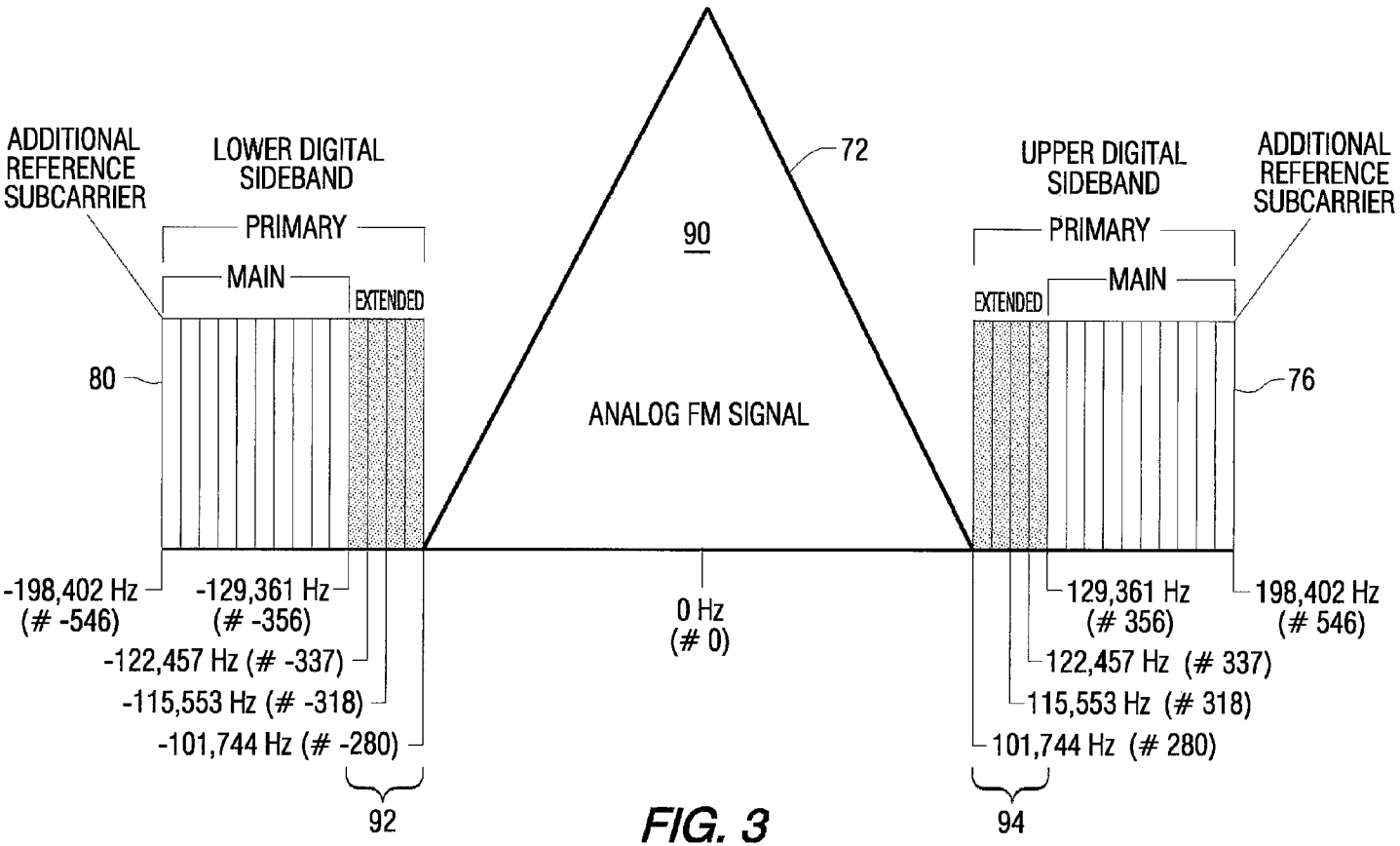
FIG. 3 is a schematic representation of an extended hybrid FM IBOC waveform.

FIG. 3 is a schematic representation of an extended hybrid FM IBOC waveform 90. The extended hybrid waveform is created by adding primary extended sidebands 92, 94 to the primary main sidebands present in the hybrid waveform. One, two, or four frequency partitions can be added to the inner edge of each primary main sideband. The extended hybrid waveform includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337 through −355 (one frequency partition), −318 through −355 (two frequency partitions), or −280 through −355 (four frequency partitions). The amplitude of each subcarrier can be scaled by an amplitude scale factor.

Figure 4:
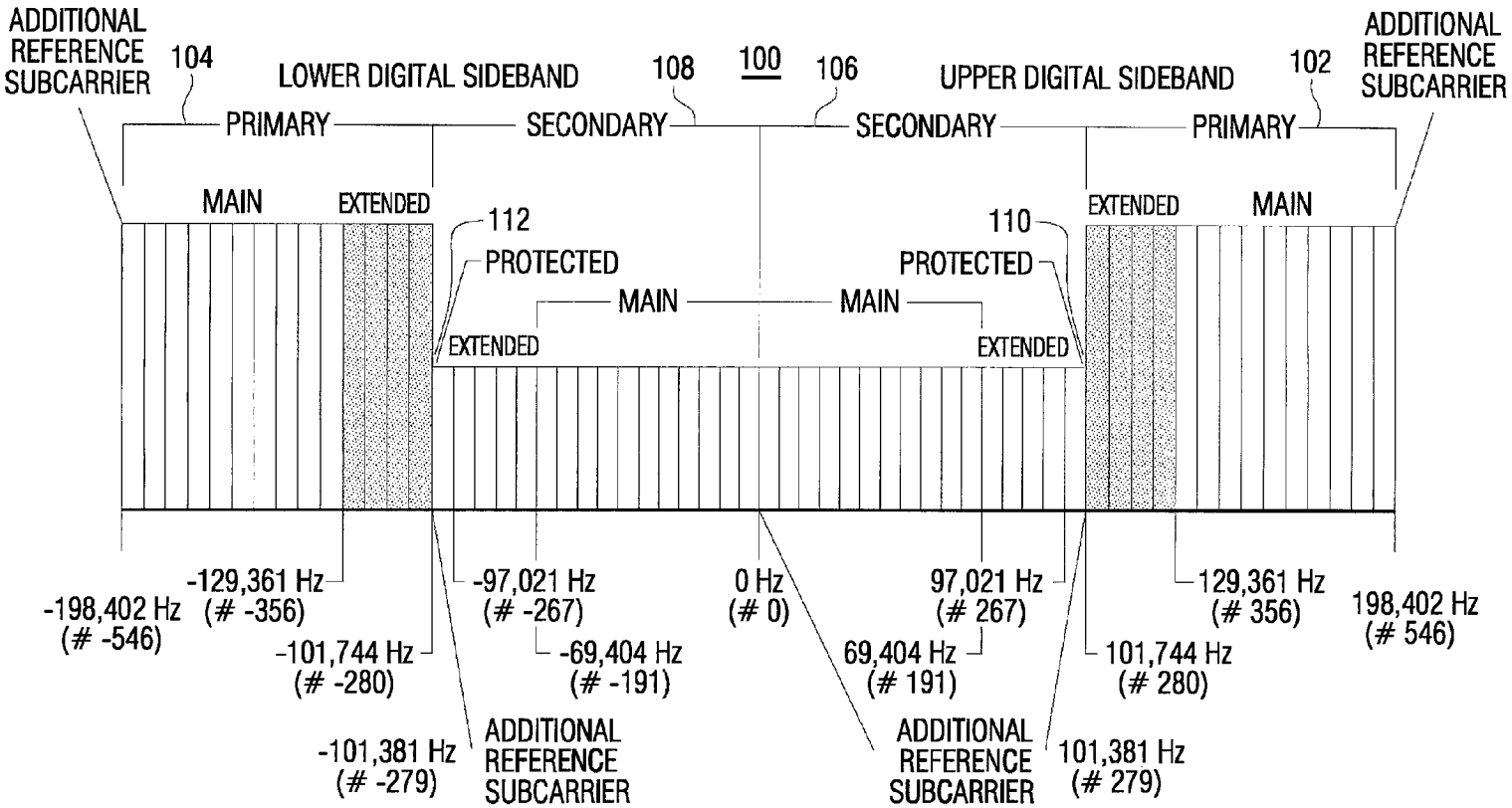
FIG. 4 is a schematic representation of an all-digital FM IBOC waveform.

FIG. 4 is a schematic representation of an all-digital FM IBOC waveform 100. The all-digital waveform is constructed by disabling the analog signal, fully expanding the bandwidth of the primary digital sidebands 102, 104, and adding lower-power secondary sidebands 106, 108 in the spectrum vacated by the analog signal. The all-digital waveform in the illustrated embodiment includes digitally modulated subcarriers at subcarrier locations −546 to +546, without an analog FM signal.

In addition to the ten main frequency partitions, all four extended frequency partitions are present in each primary sideband of the all-digital waveform. Each secondary sideband also has ten secondary main (SM) and four secondary extended (SX) frequency partitions. Unlike the primary sidebands, however, the secondary main frequency partitions are mapped nearer to the channel center with the extended frequency partitions farther from the center.

Each secondary sideband also supports a small secondary protected (SP) region 110, 112 including 12 OFDM subcarriers and reference subcarriers 279 and −279. The sidebands are referred to as "protected" because they are located in the area of spectrum least likely to be affected by analog or digital interference. An additional reference subcarrier is placed at the center of the channel (0). Frequency partition ordering of the SP region does not apply since the SP region does not contain frequency partitions.

Each secondary main sideband spans subcarriers 1 through 190 or −1 through −190. The upper secondary extended sideband includes subcarriers 191 through 266, and the upper secondary protected sideband includes subcarriers 267 through 278, plus additional reference subcarrier 279. The lower secondary extended sideband includes subcarriers −191 through −266, and the lower secondary protected sideband includes subcarriers −267 through −278, plus additional reference subcarrier −279. The total frequency span of the entire all-digital spectrum is 396,803 Hz. The amplitude of each subcarrier can be scaled by an amplitude scale factor. The secondary sideband amplitude scale factors can be user selectable. Any one of the four may be selected for application to the secondary sidebands.

In each of the waveforms, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform, the digital signal is transmitted in primary main (PM) sidebands on either side of the analog FM signal in the hybrid waveform. The power level of each sideband is appreciably below the total power in the analog FM signal. The analog signal may be monophonic or stereo, and may include subsidiary communications authorization (SCA) channels.

In the extended hybrid waveform, the bandwidth of the hybrid sidebands can be extended toward the analog FM signal to increase digital capacity. This additional spectrum, allocated to the inner edge of each primary main sideband, is termed the primary extended (PX) sideband.

In the all-digital waveform, the analog signal is removed and the bandwidth of the primary digital sidebands is fully extended as in the extended hybrid waveform. In addition, this waveform allows lower-power digital secondary sidebands to be transmitted in the spectrum vacated by the analog FM signal.

Figure 5:
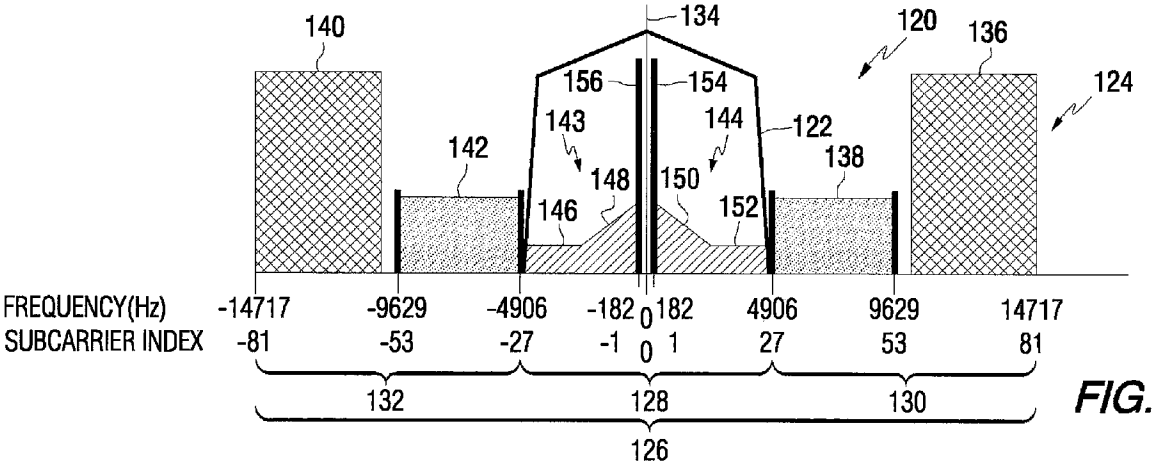
FIG. 5 is a schematic representation of a hybrid AM IBOC DAB waveform.

FIG. 5 is a schematic representation of an AM hybrid IBOC DAB waveform 120. The hybrid format includes the conventional AM analog signal 122 (bandlimited to about ±5 kHz) along with a nearly 30 kHz wide DAB signal 124. The spectrum is contained within a channel 126 having a bandwidth of about 30 kHz. The channel is divided into upper 130 and lower 132 frequency bands. The upper band extends from the center frequency of the channel to about +15 kHz from the center frequency. The lower band extends from the center frequency to about −15 kHz from the center frequency.

The AM hybrid IBOC DAB signal format in one example comprises the analog modulated carrier signal 134 plus OFDM subcarrier locations spanning the upper and lower bands. Coded digital information representative of the audio or data signals to be transmitted (program material), is transmitted on the subcarriers. The symbol rate is less than the subcarrier spacing due to a guard time between symbols.

As shown in FIG. 5, the upper band is divided into a primary section 136, a secondary section 138, and a tertiary section 144. The lower band is divided into a primary section 140, a secondary section 142, and a tertiary section 143. For the purpose of this explanation, the tertiary sections 143 and 144 can be considered to include a plurality of groups of subcarriers labeled 146, 148, 150 and 152 in FIG. 5. Subcarriers within the tertiary sections that are positioned near the center of the channel are referred to as inner subcarriers, and subcarriers within the tertiary sections that are positioned farther from the center of the channel are referred to as outer subcarriers. In this example, the power level of the inner subcarriers in groups 148 and 150 is shown to decrease linearly with frequency spacing from the center frequency. The remaining groups of subcarriers 146 and 152 in the tertiary sections have substantially constant power levels. FIG. 5 also shows two reference subcarriers 154 and 156 for system control, whose levels are fixed at a value that is different from the other sidebands.

The power of subcarriers in the digital sidebands is significantly below the total power in the analog AM signal. The level of each OFDM subcarrier within a given primary or secondary section is fixed at a constant value. Primary or secondary sections may be scaled relative to each other. In addition, status and control information is transmitted on reference subcarriers located on either side of the main carrier. A separate logical channel, such as an IBOC Data Service (IDS) channel can be transmitted in individual subcarriers just above and below the frequency edges of the upper and lower secondary sidebands. The power level of each primary OFDM subcarrier is fixed relative to the unmodulated main analog carrier. However, the power level of the secondary subcarriers, logical channel subcarriers, and tertiary subcarriers is adjustable.

Using the modulation format of FIG. 5, the analog modulated carrier and the digitally modulated subcarriers are transmitted within the channel mask specified for standard AM broadcasting in the United States. The hybrid system uses the analog AM signal for tuning and backup.

Figure 6:
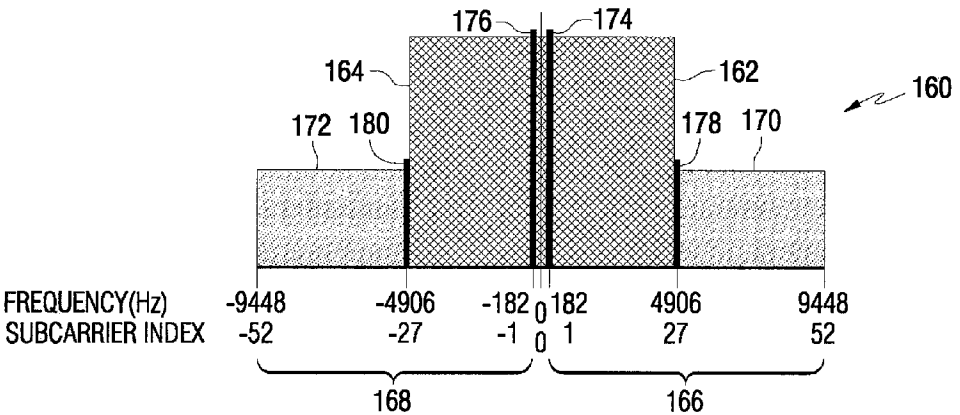
FIG. 6 is a schematic representation of an all-digital AM IBOC DAB waveform.

FIG. 6 is a schematic representation of the subcarrier assignments for an all-digital AM IBOC DAB waveform. The all-digital AM IBOC DAB signal 160 includes first and second groups 162 and 164 of evenly spaced subcarriers, referred to as the primary subcarriers, that are positioned in upper and lower bands 166 and 168. Third and fourth groups 170 and 172 of subcarriers, referred to as secondary and tertiary subcarriers respectively, are also positioned in upper and lower bands 166 and 168. Two reference subcarriers 174 and 176 of the third group lie closest to the center of the channel. Subcarriers 178 and 180 can be used to transmit program information data.

Figure 7:
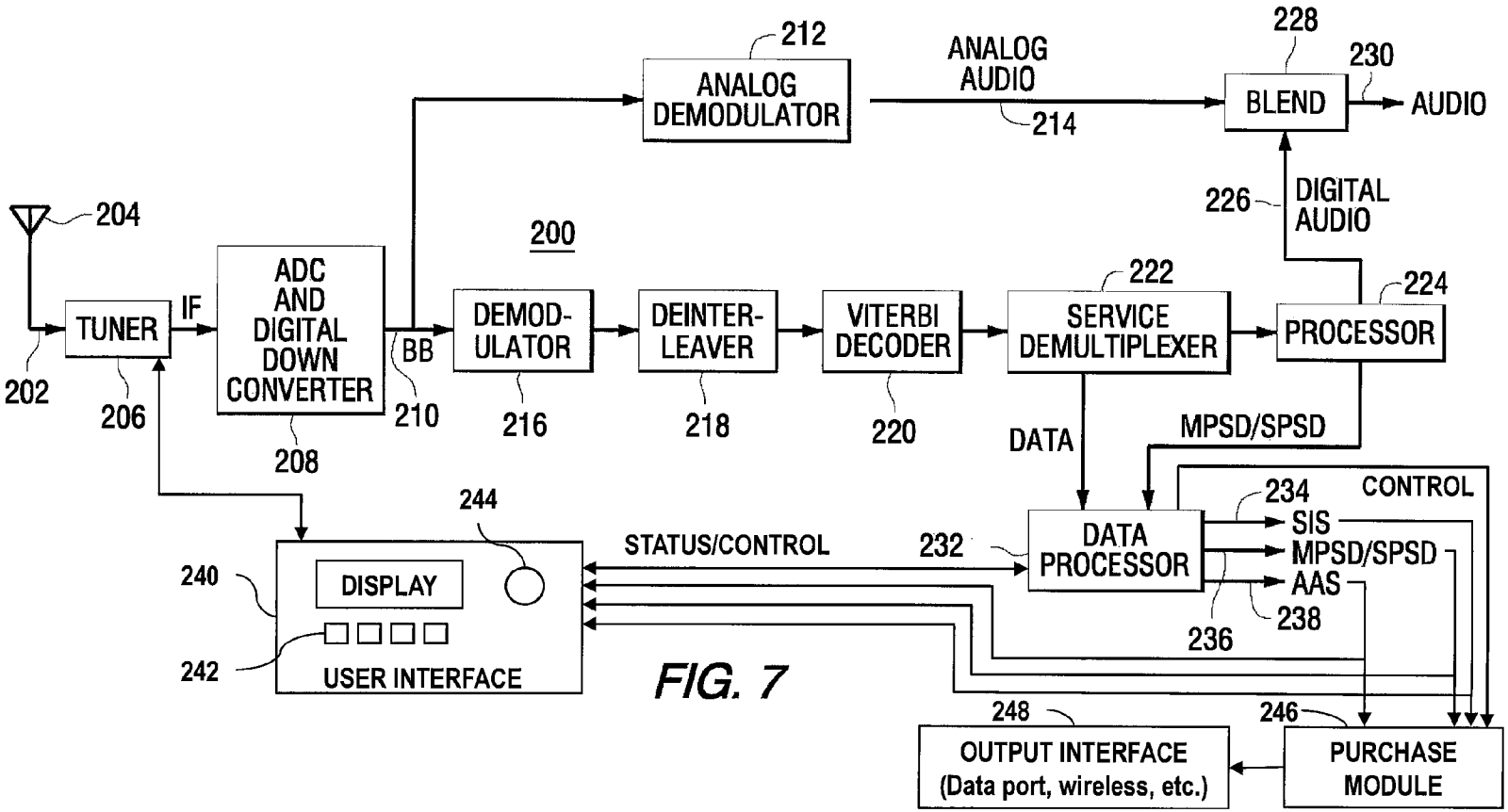
FIG. 7 is a functional block diagram of an AM IBOC DAB receiver.

FIG. 7 is a simplified functional block diagram of an AM IBOC DAB receiver 200. The receiver includes an input 202 connected to an antenna 204, a tuner or front end 206, and a digital down converter 208 for producing a baseband signal on line 210. An analog demodulator 212 demodulates the analog modulated portion of the baseband signal to produce an analog audio signal on line 214. A digital demodulator 216 demodulates the digitally modulated portion of the baseband signal. Then the digital signal is deinterleaved by a deinterleaver 218, and decoded by a Viterbi decoder 220. A service demultiplexer 222 separates main and supplemental program signals from data signals. A processor 224 processes the program signals to produce a digital audio signal on line 226. The analog and main digital audio signals are blended as shown in block 228, or a supplemental digital audio signal is passed through, to produce an audio output on line 230. A data processor 232 processes the data signals and produces data output signals on lines 234, 236 and 238. The data output signals can include, for example, a station information service (SIS), main program service data (MPSD), supplemental program service data (SPSD), and one or more auxiliary application services (AAS).

The receiver 200 also includes a user interface 240 that includes a display and control buttons 242, one of which is enabled for entering a user command that allows the user to register an interest in audio content currently being received (e.g., which may be referred to herein as a "buy" or "tag" button). Such user commands could also be entered via voice recognition for receivers so equipped. The user interface 240 may also include an indicator 244 such as a light emitting diode (LED) to indicate that program data such as program service data PSD (MPSD and/or SPSD) is sufficient to generate a data structure (e.g., a "purchase token" such as described elsewhere herein) corresponding to the audio content currently received and which identifies an associated item for which the user may desire to purchase or request further information. Such a purchase or request can be filled by a merchant via the World Wide Web (WWW) as further described elsewhere herein. The indicator 244 could also be implemented within the display instead of as a separate indicator such as an LED. The user interface 240 also communicates with the tuner 206 to control and display tuning information. The user interface 240 can include a suitable processing unit configured (e.g., programmed) to interpret SIS, PSD, and AAS signals input thereto so as to display information from those signals on the display of the user interface, e.g., such as artist and title, station identification information, visual advertising information, upcoming program features, weather or safety alerts, etc.

The receiver 200 also includes a purchase module 246 that receives PSD, AAS and SIS information to process information for a purchase or request for information. The receiver 200 further includes an output interface 248 such as, for example, a data port (e.g., USB port, serial port, etc.) and/or a wireless interface (e.g., Bluetooth, WiFi, etc.) for exporting the data structure to a suitable device (e.g., removable memory, personal computer, mobile telephone, personal digital assistant, etc.) to facilitate the purchase or request for information. The user interface 240 communicates with the data processor 232 to register the user's interest in audio content, and the data processor 232 controls the purchase module 246 to store an appropriate data structure (e.g., purchase token) which is used to implement the purchase or request for information. It will be appreciated that the purchase module 246 can be implemented in data processor 232 or any other suitable processor.

Figure 8:
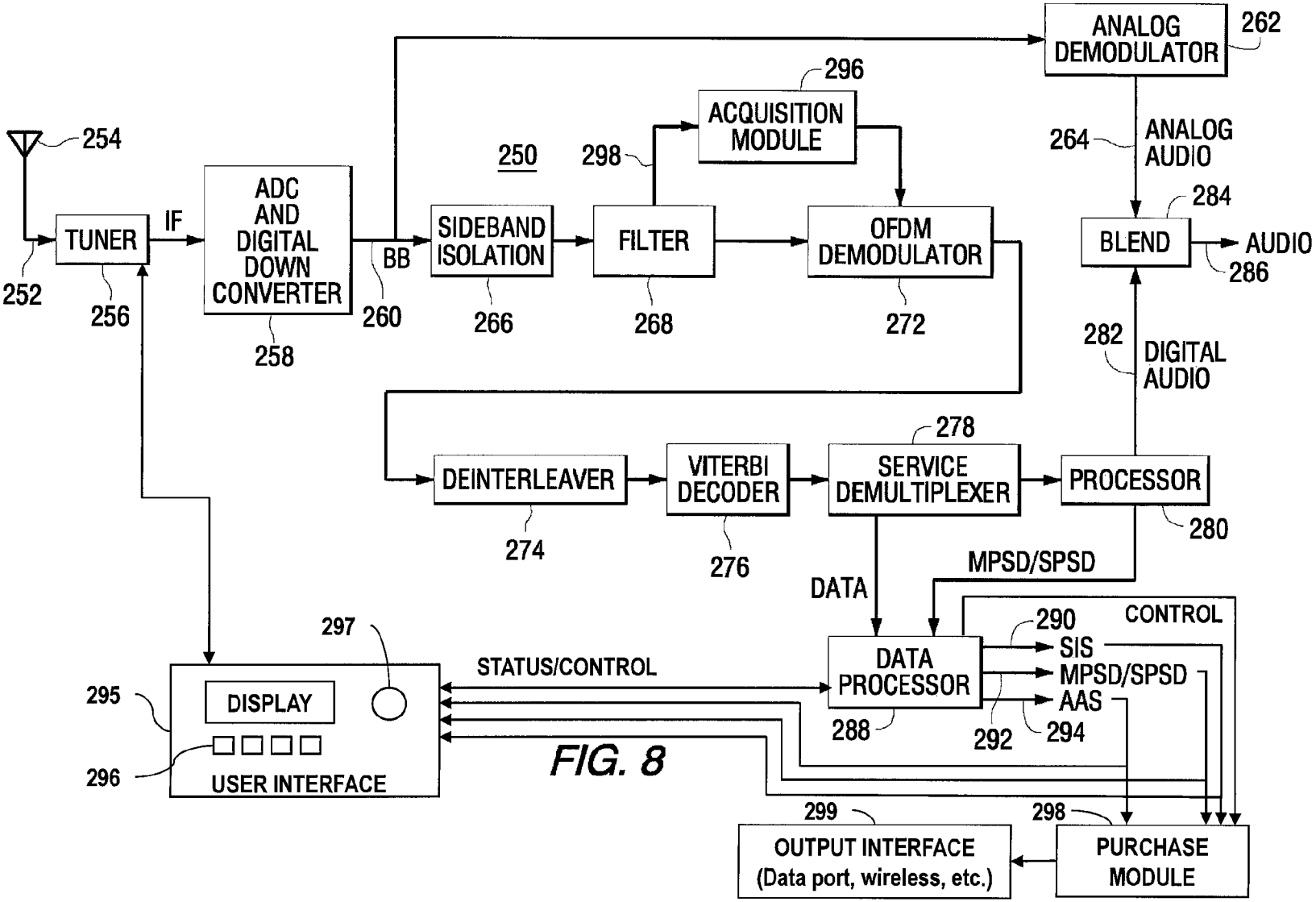
FIG. 8 is a functional block diagram of an FM IBOC DAB receiver.

FIG. 8 is a simplified functional block diagram of an FM IBOC DAB receiver 250. The receiver includes an input 252 connected to an antenna 254 and a tuner or front end 256. A received signal is provided to an analog-to-digital converter and digital down converter 258 to produce a baseband signal at output 260 comprising a series of complex signal samples. The signal samples are complex in that each sample comprises a "real" component and an "imaginary" component, which is sampled in quadrature to the real component. An analog demodulator 262 demodulates the analog modulated portion of the baseband signal to produce an analog audio signal on line 264. The digitally modulated portion of the sampled baseband signal is next filtered by sideband isolation filter 266, which has a pass-band frequency response comprising the collective set of subcarriers $f_1$-$f_n$ present in the received OFDM signal. Filter 268 suppresses the effects of a first-adjacent interferer. Complex signal 298 is routed to the input of acquisition module 296, which acquires or recovers OFDM symbol timing offset or error and carrier frequency offset or error from the received OFDM symbols as represented in received complex signal 298. Acquisition module 296 develops a symbol timing offset $\Delta t$ and carrier frequency offset $\Delta f$, as well as status and control information. The signal is then demodulated (block 272) to demodulate the digitally modulated portion of the baseband signal. Then the digital signal is deinterleaved by a deinterleaver 274, and decoded by a Viterbi decoder 276. A service demultiplexer 278 separates main and supplemental program signals from data signals. A processor 280 processes the main and supplemental program signals to produce a digital audio signal on line 282. The analog and main digital audio signals are blended as shown in block 284, or the supplemental program signal is passed through, to produce an audio output on line 286. A data processor 288 processes the data signals and produces data output signals on lines 290, 292 and 294. The data output signals can include, for example, a station information service (SIS), main program service data (MPSD), supplemental program service data (SPSD), and one or more advanced application services (AAS).

The receiver 250 also includes a user interface 295 that includes a display and control buttons 296, one of which is enabled for entering a user command that allows the user to register an interest audio content currently being received (e.g., a "buy button" or "tag button"). Such user commands could also be entered via voice recognition for receivers so equipped. The user interface 295 may also include an indicator 297 such as an LED to indicate that program data such as program service data PSD (MPSD and/or SPSD) is sufficient to generate a data structure (e.g., a "purchase token") corresponding to the audio content currently received and which identifies an associated item for which the user may desire to purchase or request further information. Such a purchase or request can be filled by a merchant via the World Wide Web (WWW). The indicator 297 could also be implemented within the display instead of as a separate indicator such as an LED. The user interface 295 also communicates with the tuner 256 to control and display tuning information. The user interface 295 can include a suitable processing unit configured (e.g., programmed) to interpret SIS, PSD, and AAS signals input thereto so as to display information from those signals on the display of the user interface, e.g., such as artist and title, station identification information, visual advertising information, upcoming program features, weather or safety alerts, etc.

The receiver 250 also includes a purchase module 298 that receives PSD, AAS and SIS information to process information for such a purchase or request for information. The receiver 250 further includes an output interface 299 such as, for example, a data port (e.g., USB port, serial port, etc.) and/or a wireless interface (e.g., Bluetooth, WiFi, etc.) for exporting the data structure to a suitable device (e.g., removable memory, personal computer, mobile telephone, personal digital assistant, etc.) to facilitate the purchase or request for information. The user interface 299 communicates with the data processor 288 to register the user's interest in audio content, and the data processor 288 controls the purchase module 298 to store an appropriate data structure (e.g., purchase token) which is used to implement the purchase or request for information. It will be appreciated that the purchase module can be implemented in data processor 288 or any other suitable processor.

In practice, many of the signal processing functions shown in the receivers of FIGS. 7 and 8 can be implemented using one or more integrated circuits.

Figure 9A:
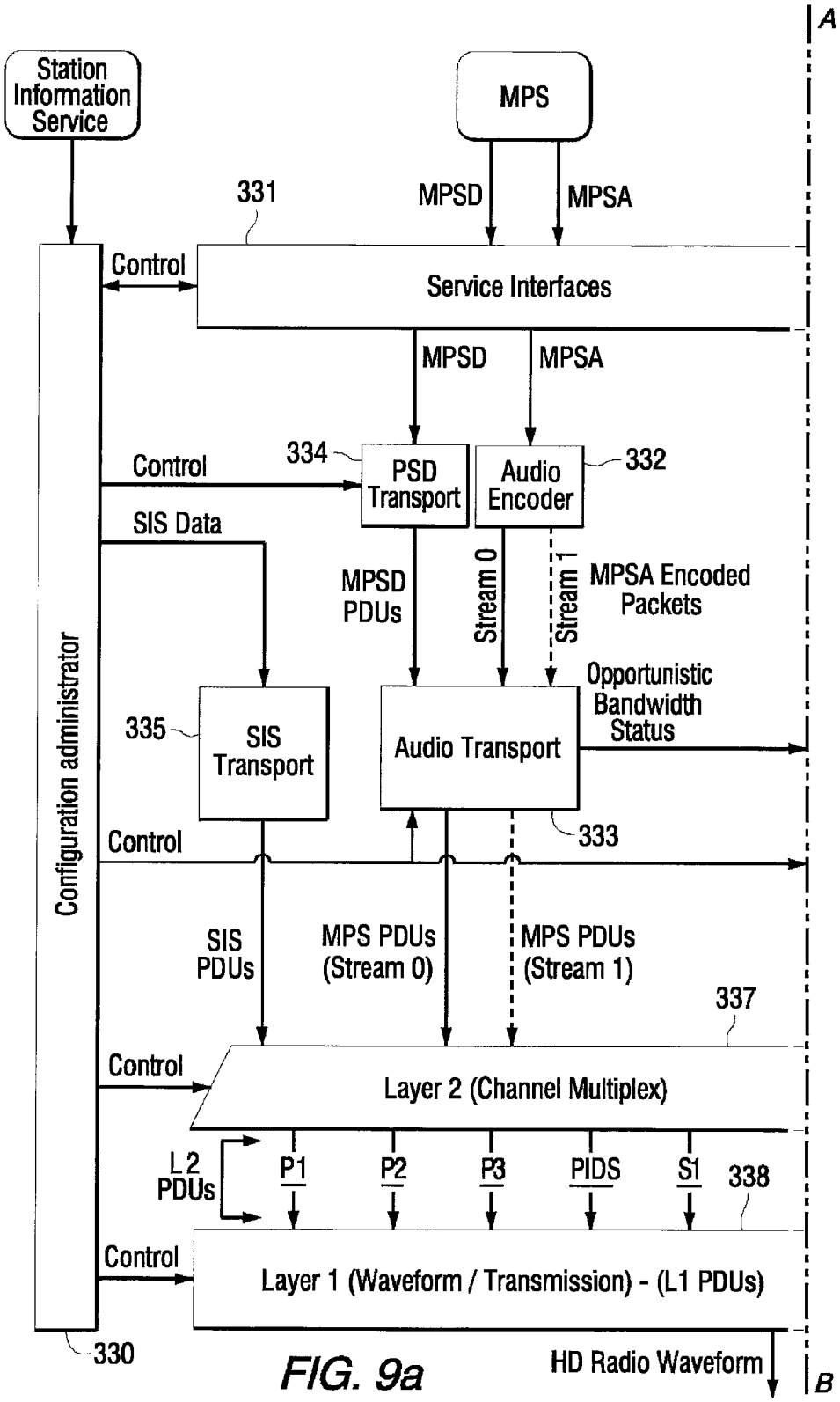
FIGS. 9*a* and 9*b* are diagrams of an IBOC DAB logical protocol stack from the broadcast perspective.
Figure 9B:
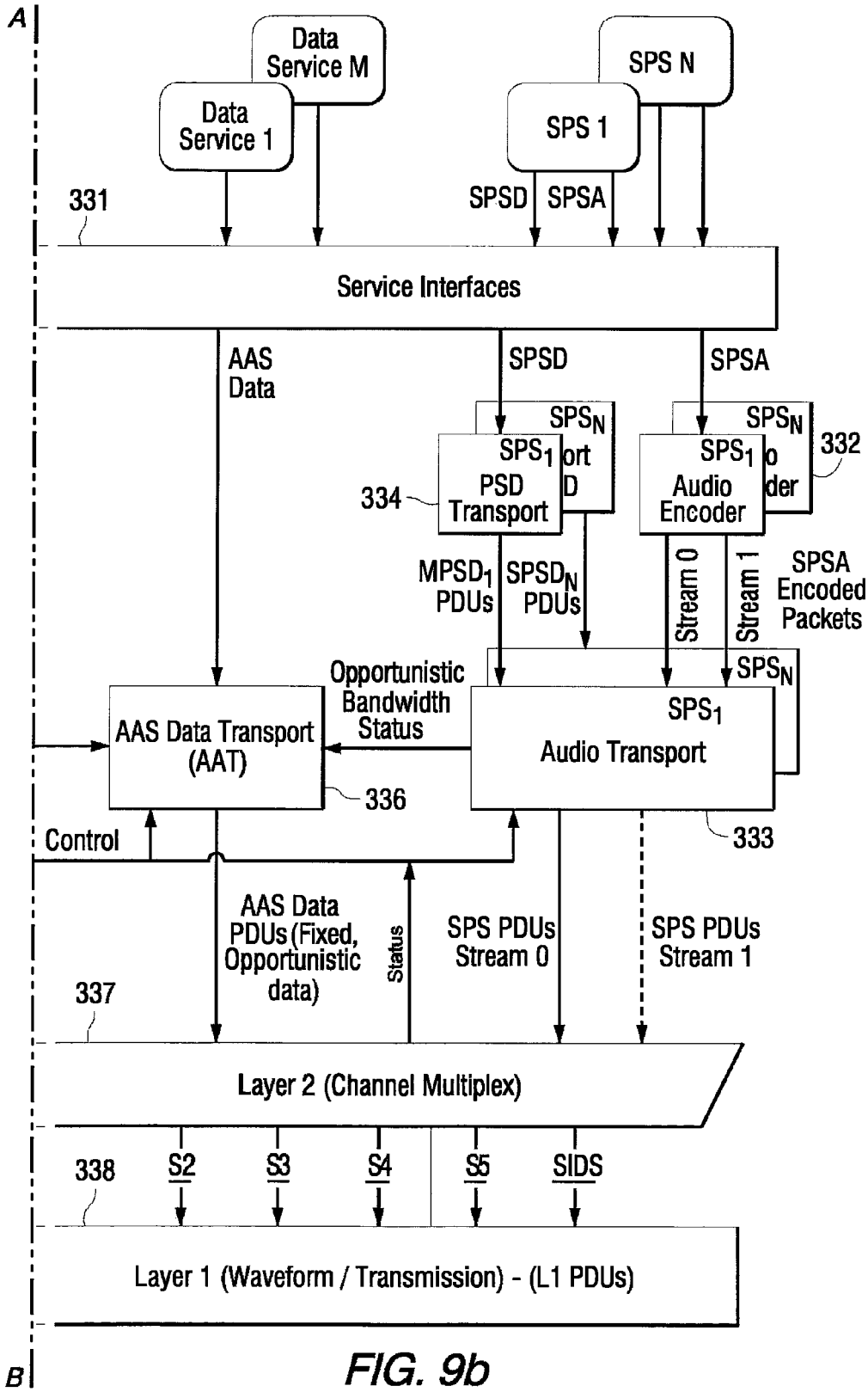

FIGS. 9*a* and 9*b* are diagrams of an IBOC DAB logical protocol stack from the transmitter perspective. From the receiver perspective, the logical stack will be traversed in the opposite direction. Most of the data being passed between the various entities within the protocol stack are in the form of protocol data units (PDUs). A PDU is a structured data block that is produced by a specific layer (or process within a layer) of the protocol stack. The PDUs of a given layer may encapsulate PDUs from the next higher layer of the stack and/or include content data and protocol control information originating in the layer (or process) itself. The PDUs generated by each layer (or process) in the transmitter protocol stack are inputs to a corresponding layer (or process) in the receiver protocol stack.

As shown in FIGS. 9*a* and 9*b*, there is a configuration administrator 330, which is a system function that supplies configuration and control information to the various entities within the protocol stack. The configuration/control information can include user defined settings, as well as information generated from within the system such as GPS time and position. The service interfaces 331 represent the interfaces for all services except SIS. The service interface may be different for each of the various types of services. For example, for MPS audio and SPS audio, the service interface may be an audio card. For MPS data and SPS data the interfaces may be in the form of different application program interfaces (APIs). For all other data services the interface is in the form of a single API. An audio codec 332 encodes both MPS audio and SPS audio to produce core (Stream 0) and optional enhancement (Stream 1) streams of MPS and SPS audio encoded packets, which are passed to audio transport 333. Audio codec 332 also relays unused capacity status to other parts of the system, thus allowing the inclusion of opportunistic data. MPS and SPS data is processed by program service data (PSD) transport 334 to produce MPS and SPS data PDUs, which are passed to audio transport 333. Audio transport 333 receives encoded audio packets and PSD PDUs and outputs bit streams containing both compressed audio and program service data. The SIS transport 335 receives SIS data from the configuration administrator and generates SIS PDUs. A SIS PDU can contain station identification and location information, program type, as well as absolute time and position correlated to GPS. The AAS data transport 336 receives AAS data from the service interface, as well as opportunistic bandwidth data from the audio transport, and generates AAS data PDUs, which can be based on quality of service parameters. The transport and encoding functions are collectively referred to as Layer 4 of the protocol stack and the corresponding transport PDUs are referred to as Layer 4 PDUs or L4 PDUs. Layer 2, which is the channel multiplex layer, (337) receives transport PDUs from the SIS transport, AAS data transport, and audio transport, and formats them into Layer 2 PDUs. A Layer 2 PDU includes protocol control information and a payload, which can be audio, data, or a combination of audio and data. Layer 2 PDUs are routed through the correct logical channels to Layer 1 (338), wherein a logical channel is a signal path that conducts L1 PDUs through Layer 1 with a specified grade of service. There are multiple Layer 1 logical channels based on service mode, wherein a service mode is a specific configuration of operating parameters specifying throughput, performance level, and selected logical channels. The number of active Layer 1 logical channels and the characteristics defining them vary for each service mode. Status information is also passed between Layer 2 and Layer 1. Layer 1 converts the PDUs from Layer 2 and system control information into an AM or FM IBOC DAB waveform for transmission. Layer 1 processing can include scrambling, channel encoding, interleaving, OFDM subcarrier mapping, and OFDM signal generation. The output of OFDM signal generation is a complex, baseband, time domain pulse representing the digital portion of an IBOC signal for a particular symbol. Discrete symbols are concatenated to form a continuous time domain waveform, which is modulated to create an IBOC waveform for transmission.

Figure 10:
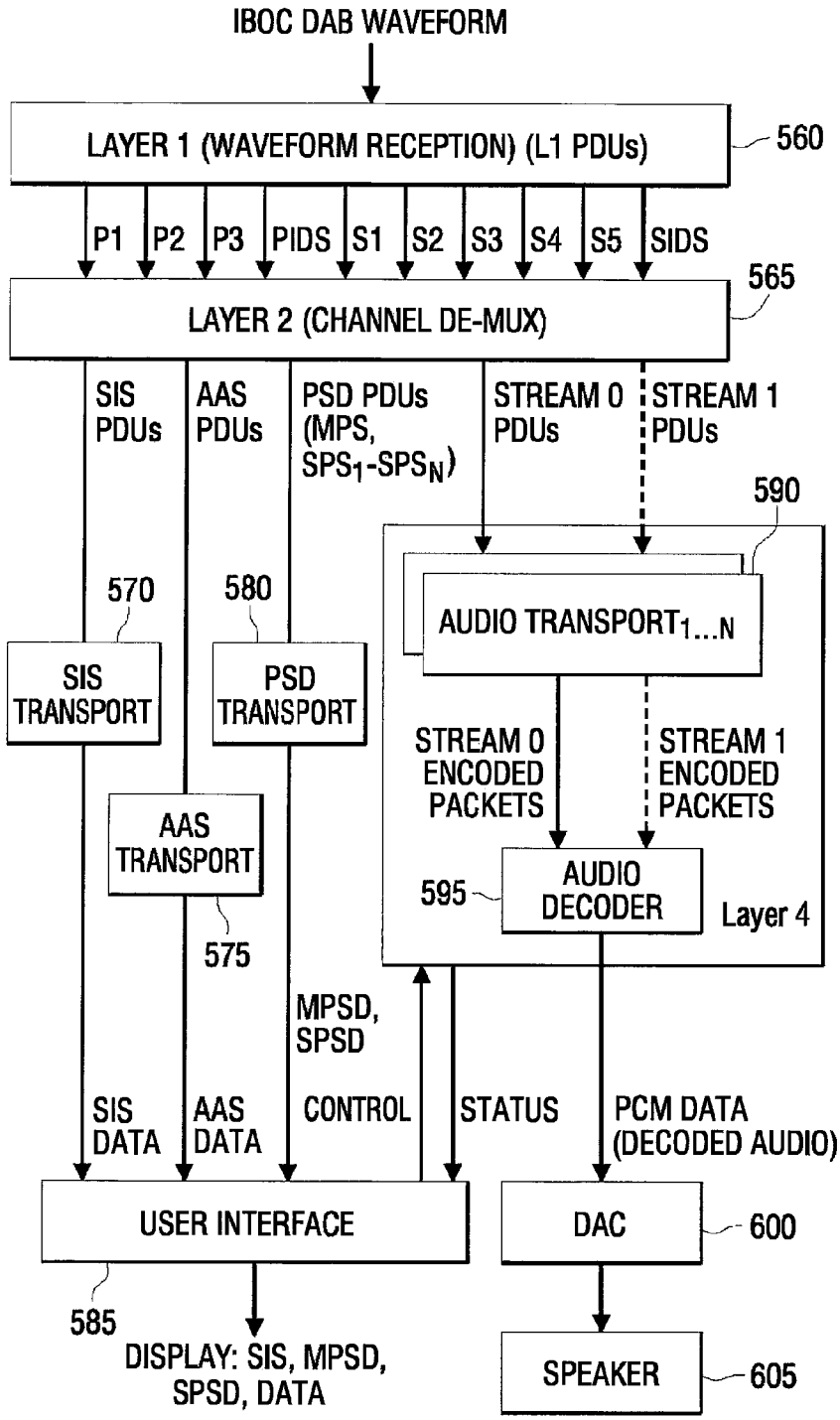
FIG. 10 is a diagram of an IBOC DAB logical protocol stack from the receiver perspective.

FIG. 10 shows the logical protocol stack from the receiver perspective. An IBOC waveform is received by the physical layer, Layer 1 (560), which demodulates the signal and processes it to separate the signal into logical channels. The number and kind of logical channels will depend on the service mode, and may include logical channels P1-P3, PIDS, S1-S5, and SIDS. Layer 1 produces L1 PDUs corresponding to the logical channels and sends the PDUs to Layer 2 (565), which demultiplexes the L1 PDUs to produce SIS PDUs, AAS PDUs, PSD PDUs for the main program service and any supplemental program services, and Stream 0 (core) audio PDUs and Stream 1 (optional enhanced) audio PDUs. The SIS PDUs are then processed by the SIS transport 570 to produce SIS data, the AAS PDUs are processed by the AAS transport 575 to produce AAS data, and the PSD PDUs are processed by the PSD transport 580 to produce MPS data (MPSD) and any SPS data (SPSD). The SIS data, AAS data, MPSD and SPSD are then sent to a user interface 590. The SIS data, if requested by a user, can then be displayed. Likewise, MPSD, SPSD, and any text based or graphical AAS data can be displayed. The Stream 0 and Stream 1 PDUs are processed by Layer 4, comprised of audio transport 590 and audio decoder 595. There may be up to N audio transports corresponding to the number of programs received on the IBOC waveform. Each audio transport produces encoded MPS packets or SPS packets, corresponding to each of the received programs. Layer 4 receives control information from the user interface, including commands such as to store or play programs, and to seek or scan for radio stations broadcasting an all-digital or hybrid IBOC signal. Layer 4 also provides status information to the user interface.

Figure 11:
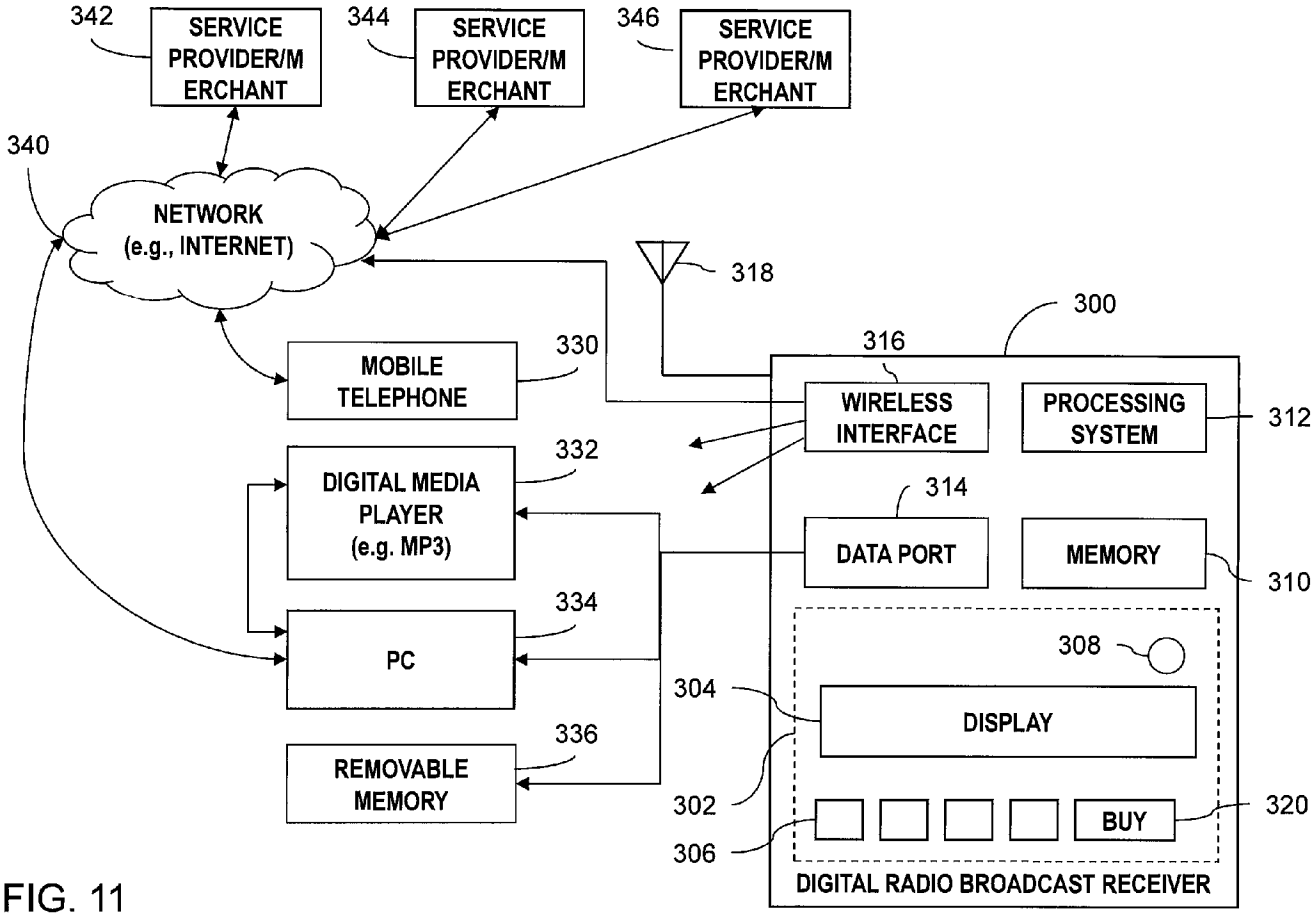
FIG. 11 illustrates an exemplary digital radio broadcast receiver 300 operating in the context of an overall system for implementing a purchase or request for information related to audio content currently received, according to an exemplary embodiment.

FIG. 11 illustrates an exemplary digital radio broadcast receiver 300 operating in the context of an overall system for implementing a purchase or request for information related to audio content currently received. The digital radio broadcast receiver 300 may be an IBOC receiver, such as described in the examples of FIGS. 7 and 8, or any other suitable type of digital terrestrial broadcast receiver or satellite broadcast receiver. In addition to receiving audio content, the digital radio broadcast receiver 300 receives program data (e.g., PSD in an IBOC receiver implementation) associated with the audio content. Based on information contained in the program data, the digital radio broadcast receiver 300 exports or directly stores a suitable data structure (e.g., a purchase token as described further herein) to a recipient device such as a mobile telephone 330, a digital media player 332, a personal computer (PC) 334, and a removable memory 336 (e.g., memory card, USB style memory stick, etc.) in response to a user command designating an interest in audio content currently received (e.g., music, talk, advertising, or any other type of audio content). The data structure comprises information identifying an associated item for which the user may desire to purchase or request further information, such as music, video, merchandise, subscriptions, or any other type of item of potential interest to the user. The data structure can then be communicated via a PC 334, Internet enabled mobile phone 330, or other suitable device to a network 340 such as the Internet, and ultimately to a suitable service provider or merchant 342, 344, 346 via any suitable software to obtain the item of interest, e.g., via download to the PC 334, mobile phone 330, or via delivery through other means such as mail or courier. In addition, it is possible for the digital radio broadcast receiver 300 to include suitable hardware including any suitable wired or wireless functionality to connect directly to the network 340 without the need for an intermediary recipient device. For example, the digital radio broadcast receiver 300 could be configured within an Internet enabled mobile telephone.

The digital radio broadcast receiver 300 includes a user interface 302 that includes a display 304, control buttons 306, memory 310, processing system 312, data port 314, wireless interface 316 and antenna 318. The digital radio broadcast receiver 300 may also include a button 320 for entering a user command that allows the user to register an interest in audio content currently being received. Such user commands could also be entered via voice recognition for receivers so equipped.

The user interface 302 may also include an indicator 308 such as an LED to indicate that program data such as program service data PSD (MPSD and/or SPSD) is sufficient to generate a data structure (e.g., a "purchase token") corresponding to the audio content currently received and which comprises information identifying an associated item for which the user may desire to purchase or request further information. The program data can be considered sufficient if it contains both the title and artist information. More preferably, the program data should additionally contain Station Information Service (SIS) Network ID and SIS Facility, program number, a Uniform Resource Locator (URL) identifying where information about an item of interest can be obtained or where it can be purchased, and a Unique File Identifier (UFID) code that further identifies the item. These will be further described herein. The indicator 308 could also be implemented within the display (e.g., display of a message) instead of as a separate indicator such as an LED. Such an indicator can be desirable because, for example, an IBOC digital radio broadcast receiver may receive solely analog information in areas where digital radio broadcast is unavailable. Regular analog transmission does not possess the program data necessary to correctly generate a data structure in response to a user interest command such as to "buy" or "tag" content. Moreover, it is possible, though unlikely, that such program data may become corrupted prior to a "buy" or "tag" command. Without such an indicator, a user may unknowingly issue one or more user commands for content of interest believing that those commands have been registered, to later find when attempting to implement a purchase that the required information is not present. This could result in a very unsatisfying user experience. The digital radio broadcast receiver 300 may also be configured such that the processing system 312 can cause the indicator 308 to blink on and off when the user's command was properly recorded (e.g., when a valid data structure described elsewhere herein was properly stored to memory 310 in response to a user command). Should the indicator fail to blink, the user would understand that there was a problem recording the user command (e.g., insufficient memory, corrupt data, etc.). A properly recorded user command could also be communicated by displaying a corresponding message on the display 304, and a problem with such a user command could also be displayed on the display 304, e.g., with a blinking error message.

The memory 310 can comprise any suitable type of memory, and the processing system 312 can comprise one or more processing units implementing suitable software and/or firmware, specialized circuitry, or combination thereof. The processing system 312 (e.g., implementing a purchase module 246, 298 such as illustrated in FIGS. 7 and 8) is configured (e.g., programmed) to store an appropriate data structure (e.g., a purchase token as described elsewhere herein) which is used to implement the purchase or request for information corresponding to audio content currently received. In one example, the memory 310 can possess 32K bytes or more of storage capacity so as to be able to store at least 64 purchase tokens, each having sizes of 512 bytes. As noted above, the data structure comprises information identifying an associated item for which the user may desire to purchase or request further information. The data port 314 can be any suitable data port such as a USB port, serial port, or specialized port compatible with devices such as various types of digital media players.

The data port 314 can be used to export one or more data structures stored in the digital radio broadcast receiver 300 to recipient devices such as a mobile telephone 330, a digital media player 332, a personal computer (PC) 334, and a removable memory 336 (e.g., memory card, USB style memory stick, etc.) in response to the user command designating an interest in audio content currently received. If a removable memory 336, PC 334, or digital media player 332, for example, are coupled to the digital radio broadcast receiver 300 when the user command is entered, the data structure can be directly stored to those devices rather than storing the data structure in memory 310. The digital radio broadcast receiver 300 may also include a wireless interface 316 such as Bluetooth or WiFi, for example, which can be used to export data structures to such recipient devices. As noted above, it is also possible for the digital radio broadcast receiver 300 to include suitable hardware including any suitable wired or wireless functionality to connect directly to the network 340 without the need for an intermediary recipient device. For example, the digital radio broadcast receiver 300 could be configured within an Internet enabled mobile telephone.

According to one example, during reception of music, a user may enter a user command at the user interface 302, e.g., by pressing the button 320, to register an interest in the song being played. The processing system 312 registers the user's interest by storing any suitable flag or indicator in memory 310. The user can thus tag content of interest to the user. The processing system 312 then processes program data corresponding to the audio currently received to generate a data structure such as a purchase token for an item or items of potential interest. If the processing system determines that there is an ambiguity associated with the content in which the user is interested, the processing system 312 can process additional program data associated with additional audio content that preceded or follows the audio content in which the user is purportedly interested in. For purposes of processing such additional program data corresponding to such additional audio content, the processing system 312 can store prior received program data in the memory 310 such that the prior received program data is suitably buffered for further processing, if necessary. Additional exemplary details regarding the handling of ambiguous situations in this regard are described elsewhere herein.

Figure 12:
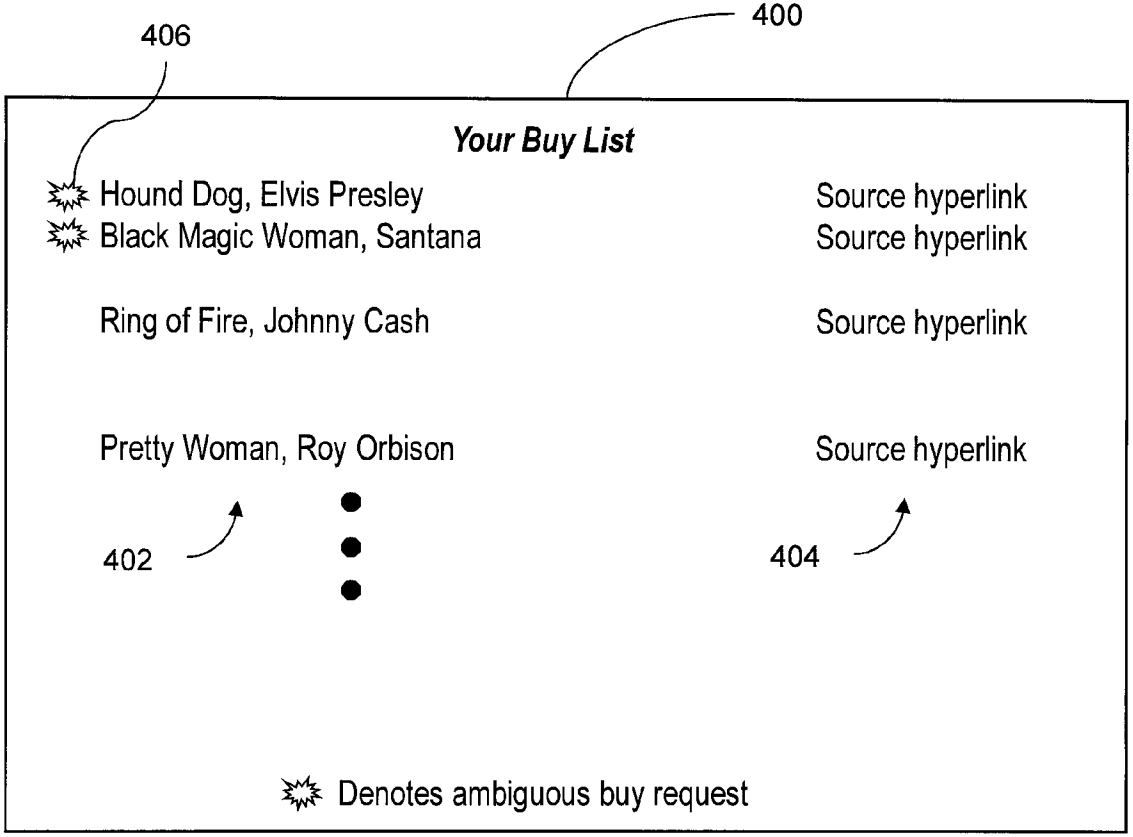
FIG. 12 illustrates an exemplary screen display associated with software for obtaining information about items of interest according to one example.
Figure 13:
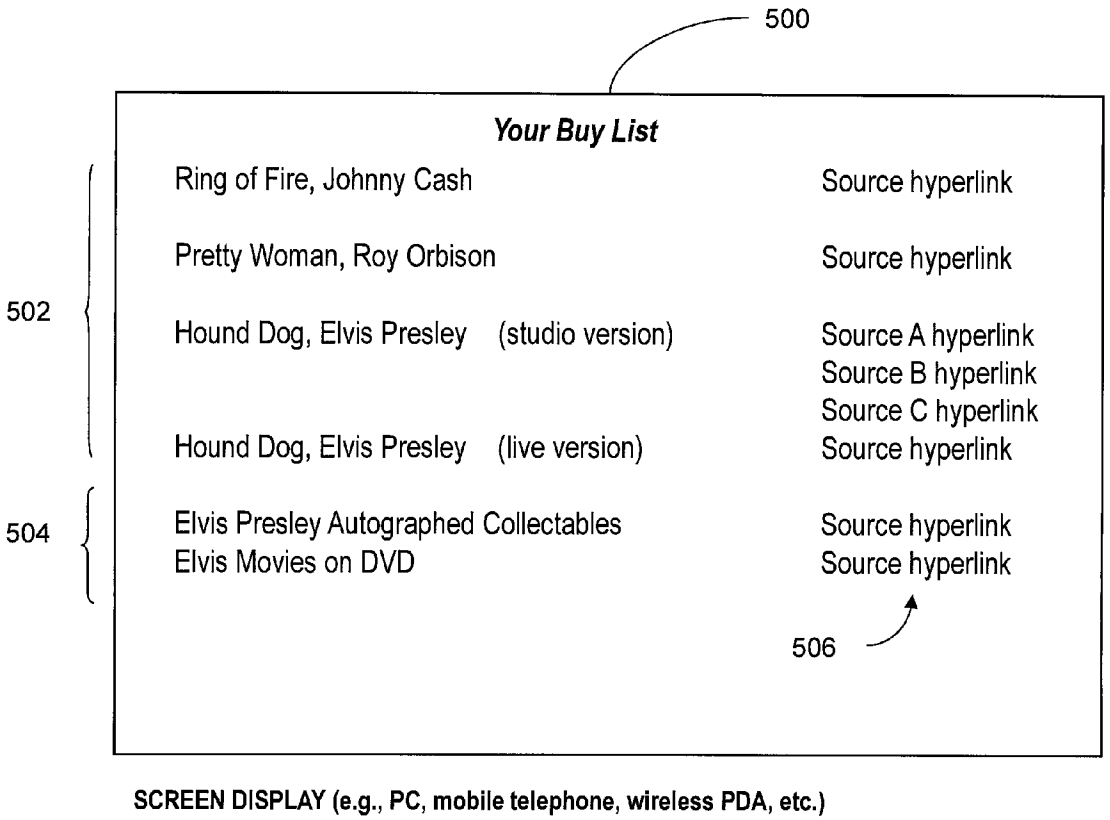
FIG. 13 illustrates another exemplary screen display associated with software for obtaining information about items of interest according to another example.

FIGS. 12 and 13 illustrate examples of screen displays that may be provided at a PC 334, Internet enabled mobile telephone 330, Internet enabled personal digital assistant (PDA), or other suitable device that can communicate with network 340 (e.g., Internet) for purchasing or obtaining information regarding an item or items of interest from service providers or merchants 342, 344, 346. It will be appreciated that such screen displays and associated communication with service providers or merchants 342, 344, 346 can be carried out using suitable software running on a user's local PC or other computing platform and/or a server of a service provider or merchant 342, 344, 346. The implementation of such software is within the purview of one of ordinary skill in the art with knowledge of the format of the data structure generated by the digital radio broadcast receiver 300.

FIG. 12 illustrates an exemplary screen display 400 following startup of such software and associated processing of the data structure by the software. The software could be started automatically, for example, by docking a digital media player (e.g., MP3 player) containing a stored data structure to a PC. The screen display 400 illustrates "Your Buy List" with artist and title information 402 for several songs, along with hyperlinks 404 to sources from which those songs may be obtained. In this example, the processing system 312 of digital radio broadcast receiver 300 has identified an ambiguity in the song of interest associated with the user command entered at the digital radio broadcast receiver 300 and has stored a data structure for the purported song of interest as well as program data for a song received immediately adjacent to the purported song of interest. The software processes these data structures and displays both songs to the user, flagging them with flags 406 as being associated with an ambiguous request as to the content of interest, so that the user can choose between them. The user can proceed to obtain further information about any or all songs listed by selecting (e.g., clicking on) the corresponding hyperlinks associated with sources for the desired information, and can purchase a desired selection(s) by following the instructions provided by following the respective hyperlinks. Both the song information (artist, title) and the hyperlink information visible on the screen display 400 are provided in the program data broadcast to the digital radio broadcast receiver 300 and are stored in the associated data structures. This information is then utilized by the software that generates the corresponding screen display 400.

FIG. 13 illustrates an exemplary screen display 500 in which "Your Buy List" includes a list 502 of several songs, a list of merchandise available that is associated with one of the songs, and corresponding hyperlinks 506 for obtaining further information about the items or for purchasing the items. In this example, the screen display shows multiple hyperlink sources for one of the songs ("Hound Dog") as well as the option of selecting the studio version and/or the live version of that song. The hyperlink information for the multiple sources of the studio version of the song and the artist, title and hyperlink information for the live version of the song are provided in the program data broadcast to the digital radio broadcast receiver 300 and are stored in the associated data structures. This information is then utilized by the software that generates the corresponding screen display. Likewise, the identifying information for the merchandise associated with the artist Elvis Presley and the corresponding hyperlink for sources for the merchandise are provided in the program data broadcast to the digital radio broadcast receiver 300 and are stored in the associated data structures. This information is then utilized by the software that generates the corresponding screen display 500.

As referred to herein, program data refers to information broadcast by digital radio broadcast transmission in addition to audio content (e.g., music, talk, etc.) and visual content (e.g., that can be displayed on a digital radio broadcast receiver such as advertising, upcoming program features, weather and safety alerts, etc.), wherein the program data identifies content such as audio content and may identify one or more items associated with such content that may be of interest to a user. One example of program data is MPSD and/or SPSD (wherein either or both cases may simply be referred to herein as program service data "PSD." Another example of program data is AAS. Exemplary program data formats suitable for implementing the approaches described above for an IBOC receiver context will now be described with reference to FIGS. 14-19. It will be appreciated that these non-limiting examples may be modified as appropriate for implementation in other digital radio broadcast scenarios, such as, for example satellite radio. The examples below relate to transmission of program service data (PSD) for an IBOC transmission, and it should be understood that this description of PSD is intended as a non-limiting example of program data that may be utilized in IBOC or other digital radio broadcast contexts.

Figure 14:
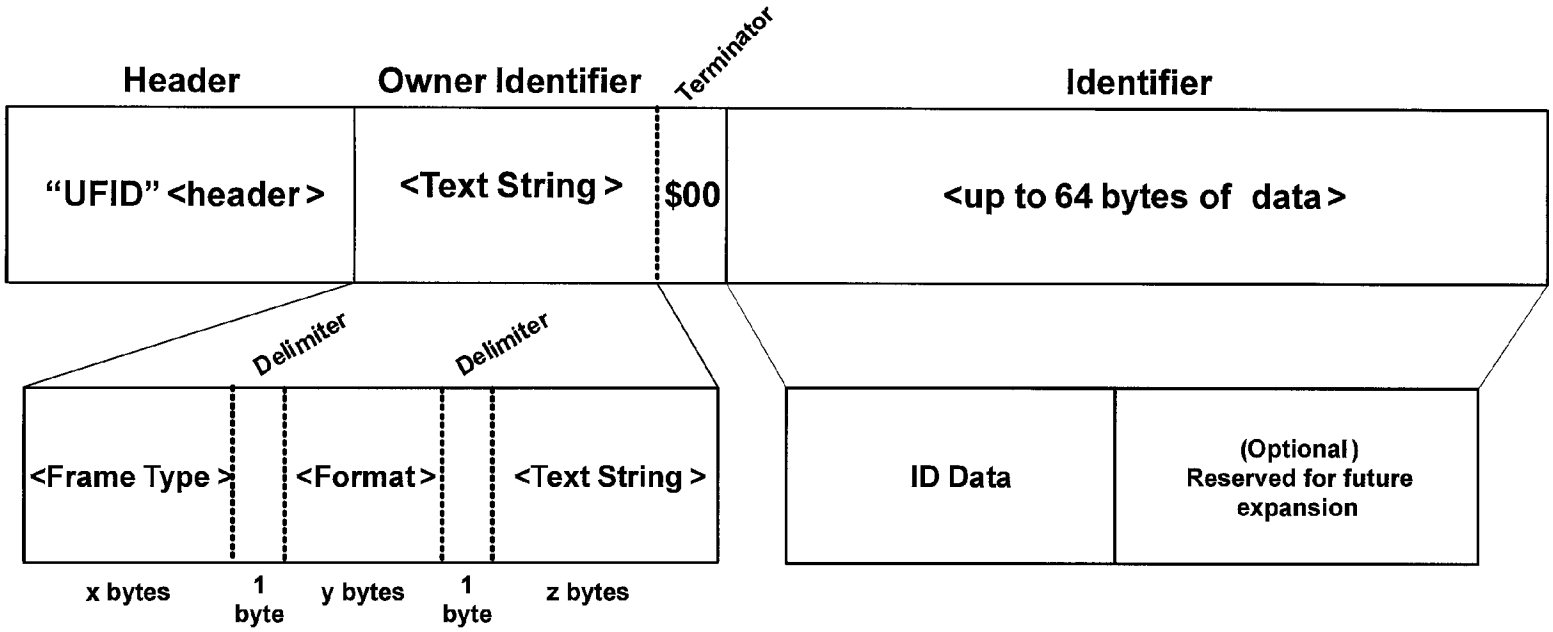
FIG. 14 illustrates the format of a general UFID frame that conforms to the ID3 standard (top) and exemplary Owner Identifier and Identifier information (bottom) structured according to one example.

Program service data suitable for implementing the approaches described above can be broadcast via digital radio broadcast in a format comprising ID3 tags with suitably structured Unique File Identifier (UFID) frames associated with corresponding audio content. The ID3 standard is conventionally used in connection with MP3 and other audio files and is well known to those of ordinary skill in the art such as described in, for example, the "ID3v2.3.0 Informal Standard" available at http://www.id3.org. ID3 tags comprises a plurality of frames, among them the Unique File Identifier (UFID) frame. FIG. 14 (top) illustrates the format of a general UFID frame that conforms to the ID3 standard and which comprises a Header, an Owner identifier field, a Terminator, and an Identifier field. FIG. 14 (bottom) illustrates exemplary Owner Identifier and Identifier fields structured to further support the approaches described herein. It will be appreciated that UFIDs as disclosed herein can be transmitted via any suitable program data including PSD, AAS, or other suitable signal. Namely, the Owner Identifier field comprises a Frame Type field, a Format field, and a URL field in the form of a text string, with associated delimiters. The Identifier field comprises an ID Data field (labeled "ID Data") and an optional field reserved for future expansion. The ID Data field includes a merchant specific identifier (which may be referred to herein as an "ID code") that uniquely identifies a particular piece of media content, and such identifiers may be obtained from particular merchants. The table shown in FIG. 15 further describes each of the various fields in the context of the approaches disclosed herein. In particular, the Frame Type indicates the format of the entire UFID frame in terms of all the bytes that follow. UFID frames are specified to contain valid defined frame types. Several frame types (more generally referred to herein as "type codes") defined by the present inventors include "APC' indicating that the UFID frame contains one or more audio product codes, "MPC" indicating that the UFID frame contains one or more merchandise product codes, and "SPC" indicating that the UFID frame contains one or more codes for subscription services. Other frame types can be defined as desired depending upon the desired application. The ID Data field depends on "Format" as will be described further with reference to the example of FIGS. 16-18.

Figure 16:
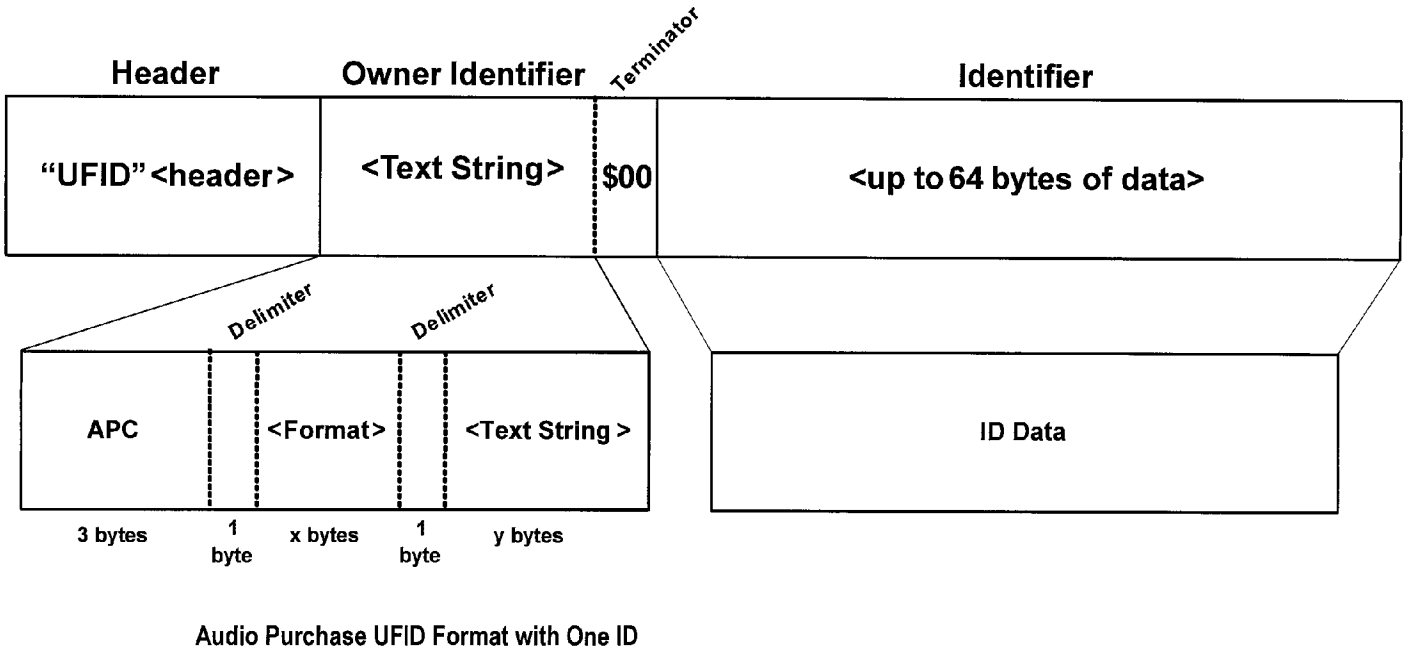
FIG. 16 illustrates an exemplary UFID format containing purchase information with one ID code according to one example.

FIG. 16 illustrates an exemplary UFID format containing purchase information with one ID code (i.e., purchase information for one item). In this audio purchase example, the Frame Type is "APC," and the format field contains a valid format code as set forth in the table shown in FIG. 17. The APC format codes (01, 02, 03, etc.) refer to particular identifier types associated with various merchants for various items. APC format codes may specify, for example, a merchant database type to which a particular ID code (e.g., for a song) pertains. As another example, an APC format code could refer to the Universal Product Code (UPC) designation generally, wherein a particular ID code for an item (e.g., a song) could be the specific UPC assigned to that song. In a merchandise purchase context, the Frame Type would be set to "MPC." The text string contains a valid URL that may provide additional information about the service provider or audio purchase. The Identifier field contains an identifier formatted as set forth by the chosen format code from FIG. 17.

Figure 18:
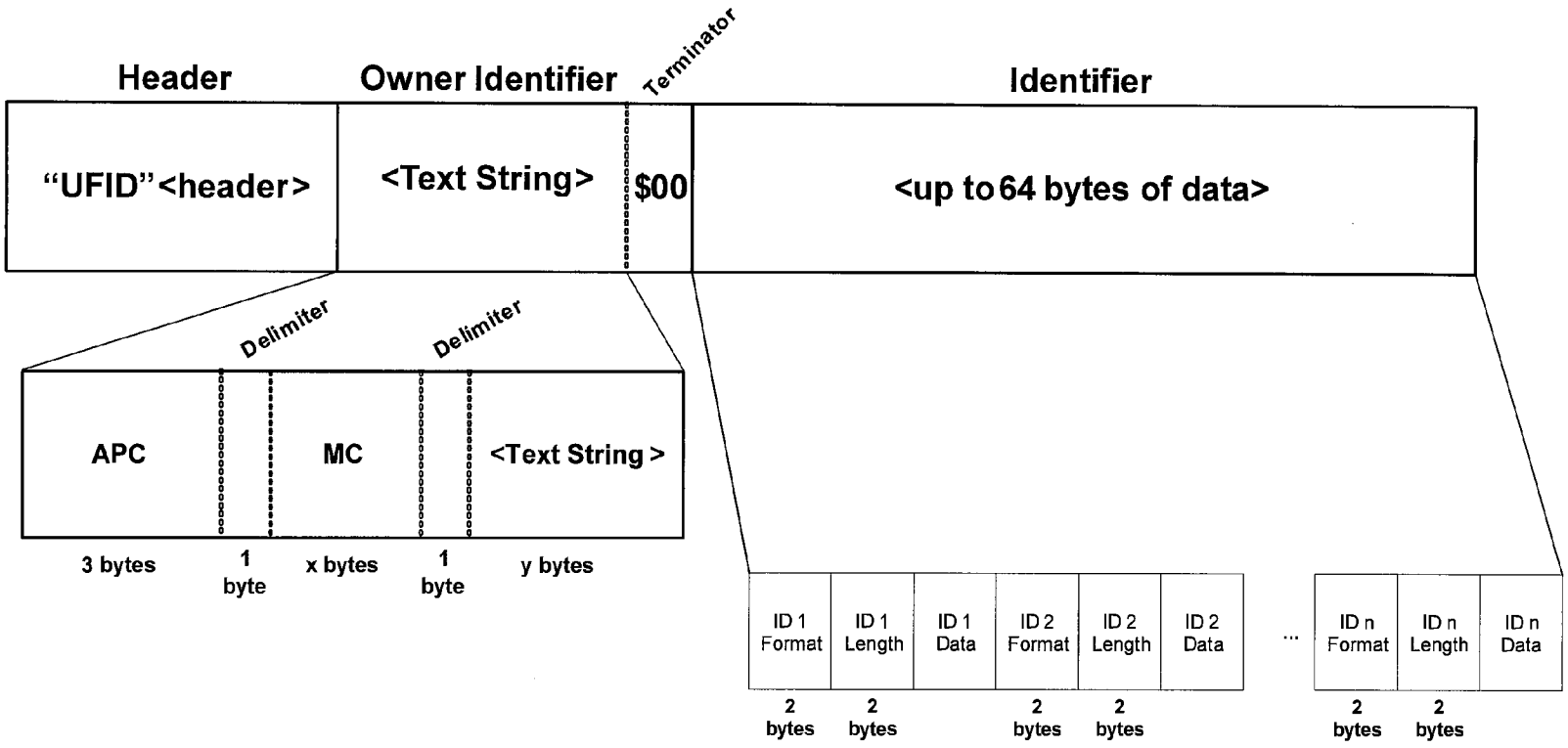
FIG. 18 illustrates an exemplary UFID format containing purchase information with multiple ID codes according to another example.

As illustrated in FIG. 18, it may be preferable to have multiple ID codes in a single UFID. This can be accomplished by setting the Format field within the Owner Identifier to "MC." In this Audio Purchase example, the Identifier field is a concatenation of multiple song ID codes. Each ID code is a concatenation of a 2-byte Format, a 2-byte ID Length, and the ID Data. Exemplary Format codes are set forth in FIG. 17. Multiple song IDs may be sent if, for example, multiple music player types are desired to be supported. If multiple song IDs are sent in a UFID with one URL, all such song IDs will be associated with the same URL. If each song ID is desired to be associated with a different URL, then multiple UFID frames may be stacked into one ID3 tag. It may also be desirable to have multiple item IDs with the same Format code within one Identifier field. For example, it may be useful to include the audio identifier codes for both the live and the studio version of a given song.

In terms of preferred practices, the PSD should properly implement the title and artist, both of which should not be used for any other purpose, the UFID URL and the UFID data. If possible, Album and Genre should also be properly implemented in the PSD.

Figure 19:
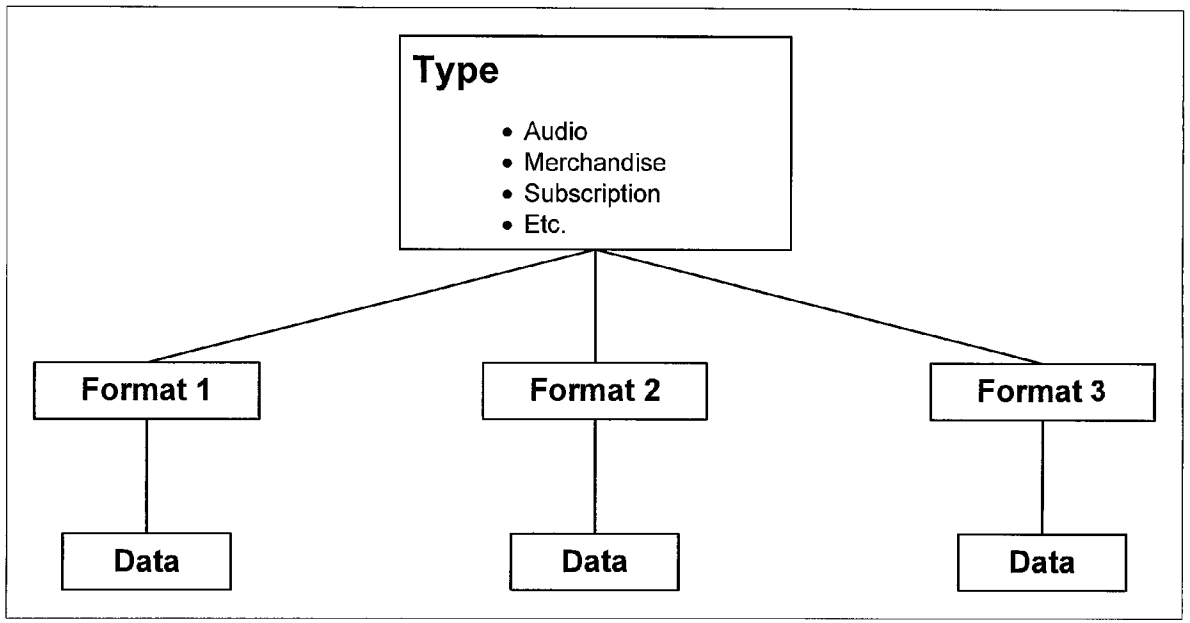
FIG. 19 schematically illustrates hierarchical encoding of Type and Format information in a UFID according to one example.

FIG. 19 schematically illustrates the hierarchical encoding as reflected in the above-described examples. Namely, the UFID specifies Type of item (e.g., audio, merchandise, subscriptions, etc.), followed by the Format, which is followed by actual data identifying a given item.

Also pertinent at the broadcast side are practices associated with transmission timing and transmission of other content. As will be discussed further herein, the present inventors have found it desirable to keep the PSD information aligned with its associated audio to within ±10 seconds. According to one example this can be achieved in the IBOC context as follows with application to all audio services regardless of service mode or logical channel:

1. PSD messages arrive at the HD Radio broadcast equipment within 0.5 seconds of each new audio segment or song.
2. One PSD message is sent per audio segment or song (e.g., repeated for the duration of the audio.
3. Maintain the size of the ID3 Tag, containing the PSD data, to less than 345 bytes.
4. ID3 UFID frame size is limited to less than 192 bytes In addition, Station Information Service (SIS) data should be appropriately transmitted. For example, the FCC Facility ID and Short Station Name can be transmitted. For those stations that use more than four characters in their station names, the Universal Short Name can be used. In addition the following fields should be properly implemented in the SIS data: Country Code, Long Station Name, ALFN (obtained via a GPS-locked time base, if possible), and Time Lock Status.

Figure 20:
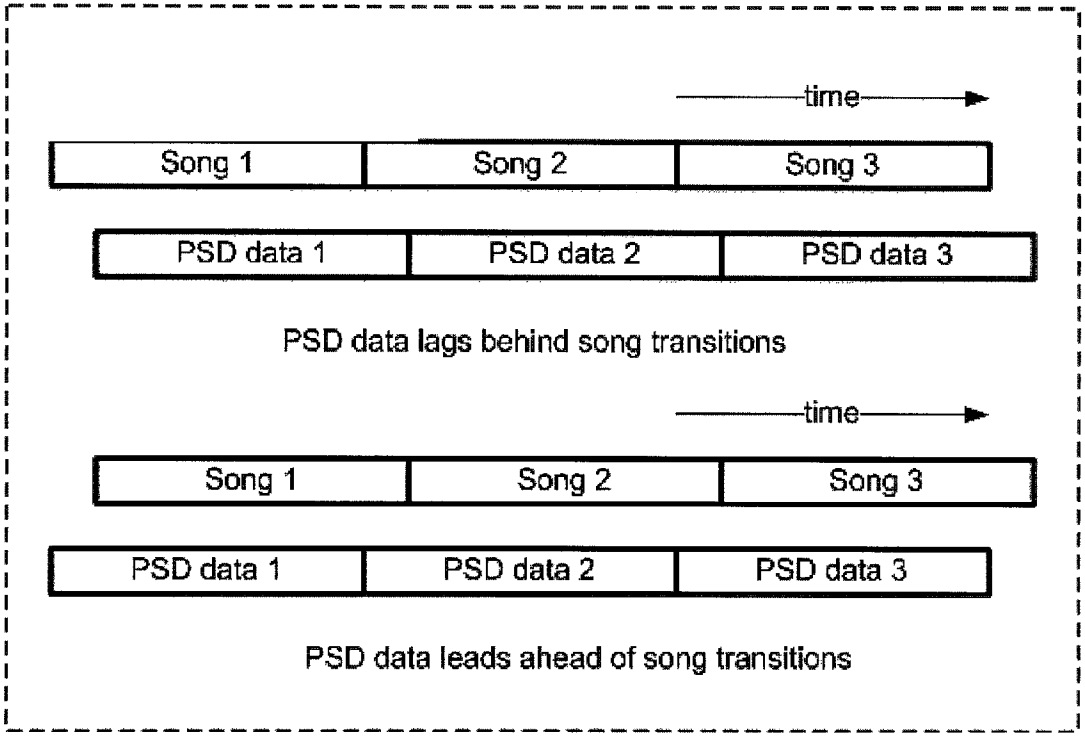
FIG. 20 illustrates exemplary scenarios regarding the relative timing of the start of audio content and the start of the associated PSD data according to one example.

As mentioned previously, the present inventors have observed that ambiguities can arise as to the proper identification of content actually desired by a user in connection with the entering of a user command such as at user interface 302 of FIG. 11. For example, FIG. 20 illustrates possible scenarios in which the start of audio content (e.g., a song or commercial) may precede the start of the associated PSD data (FIG. 20 top) by some time interval, and in which the start of audio content (e.g., a song or commercial) may follow the start of the associated PSD data (FIG. 20 bottom) by some time interval. Thus, if a user command is entered at a user interface of a digital radio broadcast receiver within such a time interval of a change in the PSD data from one PSD message to another, the user command may be registered with the PSD corresponding to the audio content other than that actually desired. In light of this observation, an exemplary approach for mitigating the effects of such ambiguities will be described with reference to FIG. 21 below.

Figure 21:
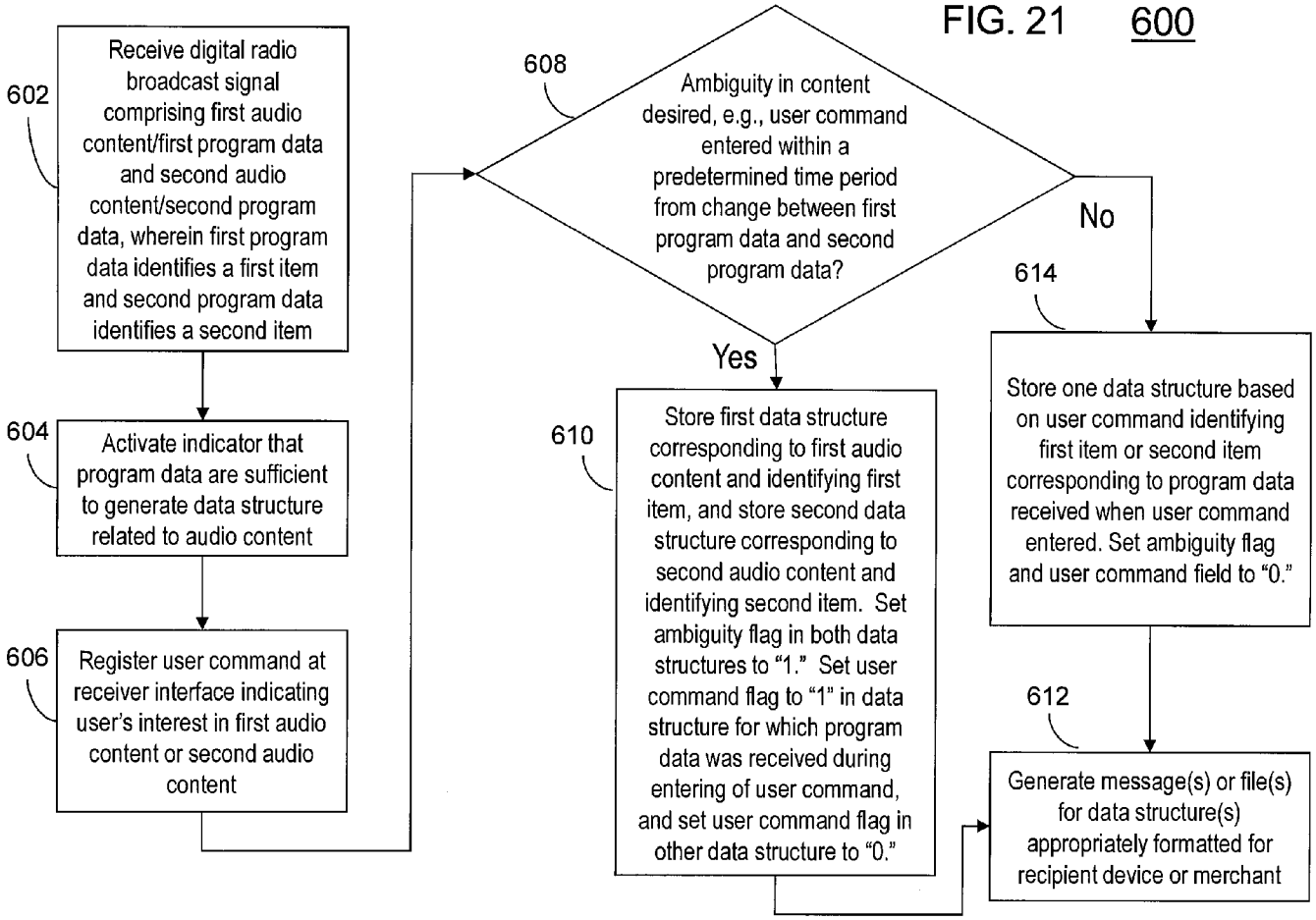
FIG. 21 illustrates an exemplary method for specifying content of interest using a digital radio broadcast receiver according to one embodiment.

According to another embodiment, FIG. 21 illustrates an exemplary method 600 for specifying content of interest using a digital radio broadcast receiver, such as but not limited to digital radio broadcast receiver 300 shown in FIG. 11. As shown at step 602, the digital radio broadcast receiver 300 receives a digital radio broadcast signal, wherein the digital radio broadcast signal comprises first audio content (e.g., such as Song 1 in FIG. 20) and first program data (e.g., such as PSD data 1 in FIG. 20). The first program data comprises information identifying a first item (e.g., music, video, merchandise, subscriptions, etc.) associated with the first audio content and may be specified in one or more UFID frames. It is not necessary that all information described previously herein in connection with UFID frames be available. For example, the Type code and the ID code can be sufficient information to identify a music selection, merchandise, subscription, etc. In another example, the Title and Artist fields of the UFID for music content can contain one or more characters, and that information can be sufficient to identify a song insofar as it is envisioned that the software used for receiving the data structure and downloading the song of interest will be able to identify a suitable URL location for obtaining the song based on artist and title alone. The digital radio broadcast signal also comprises second audio content (e.g., Song 2 in FIG. 20) received after the first audio content, and second program data (e.g., such as PSD data 2 in FIG. 20). The second program data also comprises information identifying a second item associated with the second audio content.

As shown at step 604, the processing system 312 of digital radio broadcast receiver 300 may optionally activate the indicator 308 such as described previously herein to indicate that the first program data are sufficient to generate the first data structure (e.g., the first program data contains at least title and artist information for music content). At step 606, the processing system 312 registers a user command entered at the user interface 302 of the receiver 300 during reception of either the first audio content or the second audio content. As noted previously, the user command indicates the user's interest in either the first audio content or the second audio content, respectively.

At step 608, the processing system 312 determines whether there is an ambiguity in the content desired. For example, the processing system 312 can determine whether the user command was entered at the user interface within a predetermined time period from a change between the first program data and second program data. If an ambiguity in content desired is detected, e.g., if the command was entered during the predetermined time period, then at step 610 the processing system 312 stores a first data structure corresponding to the first audio content and a second data structure corresponding to the second audio content, e.g., in either memory 310 or directly to another device coupled to the receiver 300, such as the removable memory 336, the PC 334 or the digital media player 332. The selection of the predetermined time period is within the purview of one of ordinary skill in the art and will depend upon the particular broadcast context and associated circumstances such as the observed lag or lead times between program data and associated audio content. As an example, the present inventors have found a predetermined time period of plus or minus 10 seconds to be useful in an IBOC context in view of the observed arrival times of PSD compared its associated audio content wherein it has been observed that the start of PSD may lead or lag the start of associated audio content by approximately 10 seconds.

The first data structure comprises the information identifying the first item and the second data structure comprises the information identifying the second item. In this regard, FIG. 22 illustrates a table describing the field format of an exemplary purchase token as an example of a data structure. The processing system 312 can be configured (e.g., programmed) to structure the purchase token in the manner described in the table of FIG. 22 based on mapping corresponding information received from the broadcast PSD message. As reflected in FIG. 22, the information for various fields may come from either SIS information, PSD information, or from the receiver itself (see "SOURCE" column) in this example. The "OFFSET" column refers to the placement of the particular field within the data structure in this exemplary purchase token structure. Exemplary sizes for the various fields are also listed, but are not limited thereto. In this example, information for certain fields is strongly desired ("core" under "FIELD TYPE") whereas information for other fields is optional. The exemplary purchase token includes a plurality of fields (20 in this example). Fields 1-17 are well known to those of ordinary skill in the art. Field 18 is an "ambiguous data" flag that receives the value "1" if the purchase token is stored in connection with a purchase request for which the processing system 312 determines there is an ambiguity in the desired content, and is otherwise "0." Field 19 is a "data from user command" field (or "user command field" for brevity) that receives the value "1" if the purchase token corresponds to the PSD received at the time the user command was entered at the user interface 302 (e.g., when the button 320 was pressed). The ambiguous data flag can be used to flag multiple entries on an item list of a screen display in connection with software for purchasing or obtaining information of interest, such as screen display 400 described previously in connection with FIG. 12. The user command field is useful for listing the ambiguous items in a preferred order, such as illustrated in the list shown in FIG. 12, e.g., wherein the item having the value "1" for the user command field is listed first. As further shown at step 610, since an ambiguity was detected, the processing system 312 also sets the ambiguity flags to "1" in both the first data structure and the second data structure. In addition, as shown at step 610, the processing system 312 sets the user command field to "1" in the data structure for which the associated program data was received at the time the user command was entered, and sets the user command field for the other data structure to "0." By setting the ambiguity flags and the user command fields in this way, "ambiguous" items can be appropriately flagged and listed in a screen display generated by appropriate software for purchasing an item of interest such as illustrated in FIG. 12.

As shown at step 614, if the processing system 312 identified no ambiguity with regard to the content of interest, the processing system 312 can simply store a single data structure based on the user command. In that instance, that data structure comprises information identifying the first item if the user command was entered during reception of the first program data or identifying the second item if the user command was entered during reception of the second program data. In addition, the processing system 312 can set the ambiguity flag to "0" and the user command field to "0" since no ambiguity was perceived.

As shown at steps 612, the processing system 312 can generate a message or file for each data structure stored, wherein the message or file is appropriately formatted for a particular merchant(s) or a particular recipient device(s) (e.g., mobile telephone 330, digital media player 332, PC 334, removable memory 336, etc.). Suitable approaches for generating appropriate files or messages in this regard are within the purview of those of ordinary skill in the art and will depend upon the format required by the merchant or recipient device.

According to an exemplary aspect, the first program data can comprise a Unique File Identifier (UFID) frame that includes data identifying the first item and another item of interest and a Uniform Resource Locator (URL) address for obtaining information about the first item and the other item of interest from a source via the URL. For example, a first item in this regard could be a song, and the other item could be a DVD movie starring the song artist, such as illustrated in the example of FIG. 13. According to another exemplary aspect, the first program data can comprise multiple Unique File Identifier (UFID) frames, each of which includes information identifying the first item and a Uniform Resource Locator (URL) address for obtaining information about the first item of interest, such that information can be obtained about the first item from multiple sources via the corresponding URLs. For example, as illustrated in FIG. 13, multiple URLs can identify different sources from which to obtain the same song according to various song ID codes also transmitted in the UFID frames that may correspond to various digital media player formats for that song.

According to another exemplary aspect, the first program data can comprise a Unique File Identifier (UFID) frame, wherein the UFID frame includes multiple ID codes identifying different formats in which the first item (e.g., a song, merchandise, etc.) is available, and wherein the UFID frame includes a Uniform Resource Locator (URL) address for obtaining information about the first item. FIG. 18, illustrates an exemplary UFID frame in accordance with this aspect.

According to another exemplary aspect, the first program data can comprise one or more Unique File Identifier (UFID) frames including information identifying the first item and other item of interest and including one or more Uniform Resource Locator (URL) addresses for obtaining information about the first item and the other item. For example, a radio program discussing a topic or item may be broadcast wherein the radio program is also available as a "podcast" (meaning one or more media files for distribution over the Internet using syndication feeds for playback on digital media players and personal computers). One UFID frame of the first program data in this example could contain an ID code for the podcast, an ID code for the item being discussed, and a URL address from which information about both the podcast and the item can be obtained. Alternatively, in this example, two UFID frames could be broadcast, one UFID frame including the podcast ID code and an associated URL, and another UFID frame including the item ID code and an associated URL. In all of the examples discussed in this paragraph, appropriate type codes, e.g., APC, MPC, SPC, etc., can also be broadcast in the associated UFID frames.

Figure 23:
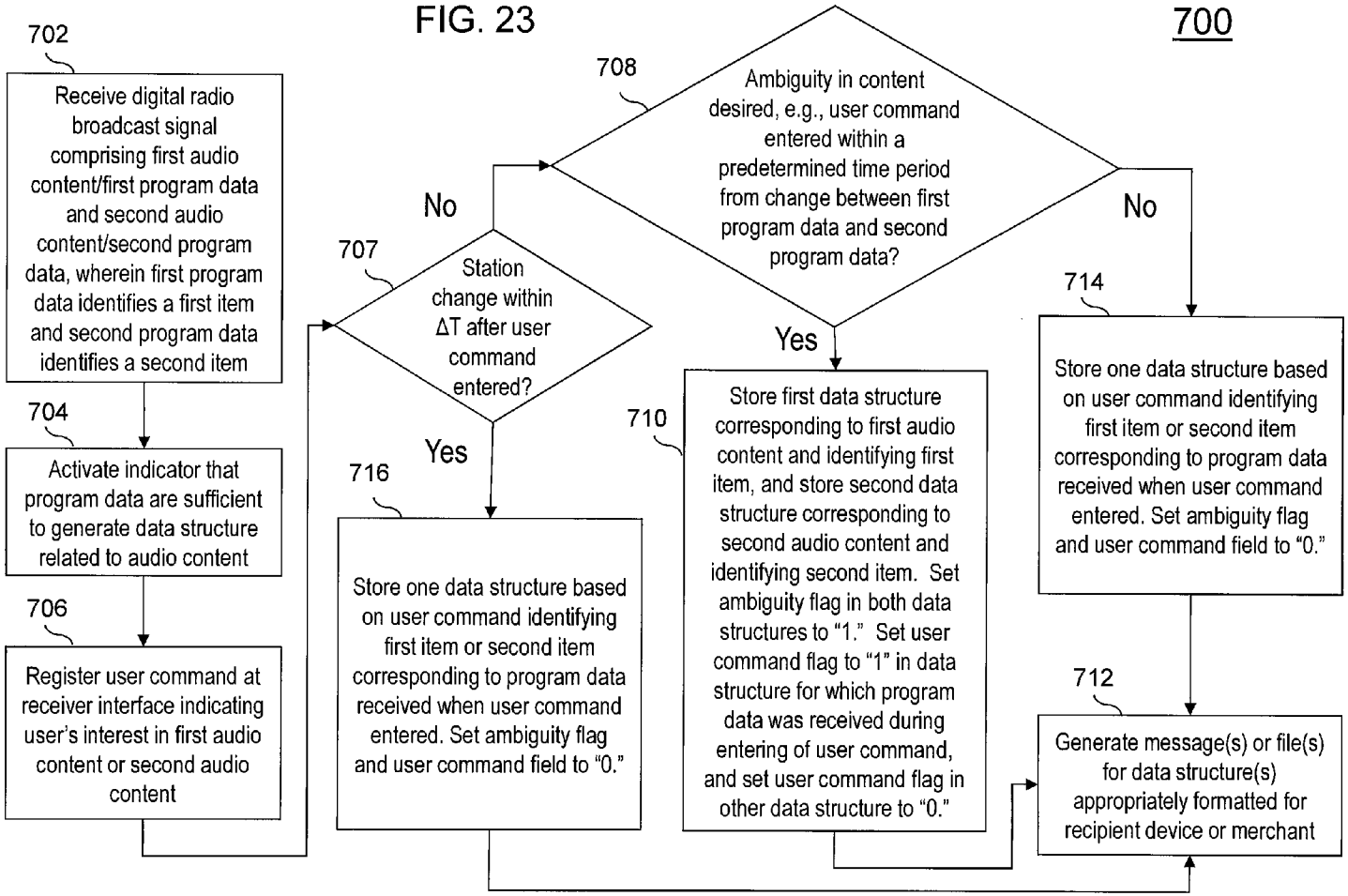
FIG. 23 illustrates another exemplary method for specifying content of interest using a digital radio broadcast receiver according to another embodiment.

According to a further embodiment, FIG. 23 illustrates an exemplary method 700 for specifying content of interest using a digital radio broadcast receiver, such as but not limited to digital radio broadcast receiver 300 shown in FIG. 11. In this embodiment, steps 702-706 and 708-714 substantially correspond to steps 602-606 and 608-614, respectively, of FIG. 21, and no further description of those steps is required. FIG. 23 presents additional steps 707 and 716, which are now described. In this example, following step 706, the processing system 312 can determine whether there was a station change within a predetermined time period ΔT after the user command was entered. This time period can the be same predetermined period referred to previously, or a different predetermined time period depending upon the nature of the lead or lag times associated with station changes and associated program data and audio content. If such a station change is detected, the method 700 proceeds to step 716 wherein the processing system can store a single data structure based on the user command. In that instance, that data structure comprises information identifying the first item if the user command was entered during reception of the first program data or identifying the second item if the user command was entered during reception of the second program data. In addition, the processing system 312 sets the ambiguity flag to "0" and the user command field to "0" since only one data structure is stored. The method proceeds from step 716 to step 712 wherein the processing system 312 can generate a message or file for the data structure stored, wherein the message or file is appropriately formatted for a particular merchant(s) or a particular recipient device(s) (e.g., mobile telephone 330, digital media player 332, PC 334, removable memory 336, etc.). If no station change was detected within ΔT after the user command was entered, the method 700 proceeds to step 708, wherein the remaining steps are carried out as previously described in connection with method 600 of FIG. 21. In this approach, a station change within ΔT after the user command was entered presents a further type of ambiguity in identifying the content desired. The method resolves that ambiguity by in a simple manner by storing one data structure, without testing for further ambiguity in program data at step 708.

According to another exemplary embodiment, a method of broadcasting digital radio broadcast data formatted to facilitate specifying content of interest using a digital radio broadcast receiver is provided. The method can be carried out using any suitable broadcasting equipment. For instance, in an IBOC context, such broadcasting equipment may include that such as described in connection with FIGS. 1, 9*a* and 9*b* herein, such as an importer, exporter, exciter and/or other suitable equipment. Such broadcast equipment may include one or more software-programmable digital signal processors, programmable/hardwired logic devices, firmware, or any other combination of hardware, software and firmware, which may collectively be referred to as a processing system. Such broadcasting equipment can be used to arrange first audio content and second audio content for broadcast via a digital radio broadcast signal, such as first and second audio content previously described herein. The broadcasting equipment can structure first program data associated with the first audio content, such that the first program data comprise a first Unique File Identifier (UFID) frame comprising a first type code specifying a type of a first item associated with the first audio content, a first ID code identifying the first item, and a first Uniform Resource Locator (URL) address for obtaining information about the first item. The broadcast equipment can also structure the second program data such that the second program data comprise a second Unique File Identifier (UFID) frame comprising a second type code specifying a type of a second item associated with the second audio content, a second ID code identifying the second item, and a second Uniform Resource Locator (URL) address for obtaining information about the second item. The broadcast equipment can generate a digital radio broadcast signal comprising the first and second audio content and the first and second program data and then transmit the digital radio broadcast signal. The digital radio broadcast signal can then be received and processed by a digital radio broadcast receiver such as described elsewhere herein.

In one exemplary aspect, the first UFID frame comprises a type code and an ID code for another item of interest in addition to type code and ID codes associated with the first item, such as previously described herein. In another exemplary aspect, the first UFID frame can comprise multiple ID codes identifying multiple different formats in which the first item is available, such as described previously herein. In another exemplary aspect, wherein the first program data can comprise multiple UFID frames, each of which includes a Uniform Resource Locator (URL) address for obtaining information about the first item of interest, such that information can be obtained about the first item from multiple sources, such as described previously herein. In a further exemplary aspect, the first program data can comprise another UFID frame, the other UFID frame including a type code and an ID code for another item of interest and including a Uniform Resource Locator (URL) address for obtaining information about the another item of interest, such as described previously herein. In another exemplary aspect, the first program data can comprise one or more type codes selected from the group consisting of "APC' indicating that the first program data include one or more audio product codes, "MPC" indicating that the first program data include one or more merchandise product codes, and "SPC" indicating that the first program data include one or more codes for subscription services, such as described previously herein.

The methods described herein may be implemented utilizing either a software-programmable digital signal processor, or a programmable/hardwired logic device, firmware, or any other combination of hardware, software and firmware sufficient to carry out the described functionality. In addition, a computer readable medium may include instructions adapted to cause a processing system to carry out the methods described herein. The computer readable medium can be any suitable medium for storing such instructions, such as but not limited to a hard disk, floppy disk, compact disk (CD), digital versatile disk (DVD), magnetic tape, other magnetic or optical storage medium, random access memory (RAM), read only memory (ROM), flash memory, etc. Such instructions may also be embodied in modulated waves/signals (such as radio frequency, audio frequency, or optical frequency modulated waves/signals) that can be downloaded to a computer so as to cause a processing system to carry out the methods described herein.

While the present invention has been described in terms of exemplary embodiments, it will be understood by those skilled in the art that various modifications can be made thereto without departing from the scope of the invention as set forth in the claims.

What is claimed is:

1. A method of generating a digital radio broadcast signal formatted to facilitate specifying content of interest using a digital radio broadcast receiver, the method comprising:

arranging first audio content and second audio content for broadcast via a digital radio broadcast signal;

structuring first program data associated with the first audio content and second program data associated with the second audio content, the first program data comprising a first Unique File Identifier (UFID) frame comprising a first type code specifying a type of a first item associated with the first audio content, a first ID code identifying the first item, and a first Uniform Resource Locator (URL) address for obtaining information about the first item, the first type code being associated with one of an audio product, a merchandise product, and a subscription service, the second program data comprising a second Unique File Identifier (UFID) frame comprising a second type code specifying a type of a second item associated with the second audio content, a second ID code identifying the second item, and a second Uniform Resource Locator (URL) address for obtaining information about the second item; and generating a digital radio broadcast signal comprising the first and second audio content and the first and second program data for transmission via digital radio broadcast.

2. The method of claim 1, wherein the first UFID frame comprises a type code and an ID code for another item of interest.

3. The method of claim 1, wherein the first UFID frame comprises multiple ID codes identifying multiple different formats in which the first item is available.

4. The method of claim 1, wherein the first program data comprises multiple UFID frames, each of which includes a Uniform Resource Locator (URL) address for obtaining information about the first item of interest, such that information can be obtained about the first item from multiple sources.

5. The method of claim 1, wherein the first program data comprises another UFID frame, the another UFID frame including a type code and an ID code for another item of interest and including a Uniform Resource Locator (URL) address for obtaining information about the another item of interest.

6. The method of claim 1, wherein the first program data comprises one or more type codes selected from the group consisting of "APC" indicating that the first program data include one or more audio product codes, "MPC" indicating that the first program data include one or more merchandise product codes, and "SPC" indicating that the first program data include one or more codes for subscription services.

7. The method of claim 1, comprising transmitting the digital radio broadcast signal.

8. The method of claim 1, wherein the UFID frame includes data identifying the first item and another item of interest, and a Uniform Resource Locator (URL) address for obtaining information about the first item and the another item of interest.

9. A digital radio broadcast system for generating broadcast data formatted to facilitate specifying content of interest using a digital radio broadcast receiver, comprising:

a processing system; and a memory coupled to the processing system, wherein the processing system is configure to:

arrange first audio content and second audio content for broadcast via a digital radio broadcast signal;

structure first program data associated with the first audio content and second program data associated with the second audio content, the first program data comprising a first Unique File Identifier (UFID) frame comprising a first type code specifying a type of a first item associated with the first audio content, a first ID code identifying the first item, and a first Uniform Resource Locator (URL) address for obtaining information about the first item, the first type code being associated with one of an audio product, a merchandise product, and a subscription service, the second program data comprising a second Unique File Identifier (UFID) frame comprising a second type code specifying a type of a second item associated with the second audio content, a second ID code identifying the second item, and a second Uniform Resource Locator (URL) address for obtaining information about the second item;

generate a digital radio broadcast signal comprising the first and second audio content and the first and second program data for transmission via digital radio broadcast.

10. The digital radio broadcast system of claim 9, wherein the first UFID frame comprises a type code and an ID code for another item of interest.

11. The digital radio broadcast system of claim 9, wherein the first UFID frame comprises multiple ID codes identifying multiple different formats in which the first item is available.

12. The digital radio broadcast system of claim 9, wherein the first program data comprises multiple UFID frames, each of which includes a Uniform Resource Locator (URL) address for obtaining information about the first item of interest, such that information can be obtained about the first item from multiple sources.

13. The digital radio broadcast system of claim 9, wherein the first program data comprises another UFID frame, the another UFID frame including a type code and an ID code for another item of interest and including a Uniform Resource Locator (URL) address for obtaining information about the another item of interest.

14. The digital radio broadcast system of claim 9, wherein the first program data comprises one or more type codes selected from the group consisting of "APC" indicating that the first program data include one or more audio product codes, "MPC" indicating that the first program data include one or more merchandise product codes, and "SPC" indicating that the first program data include one or more codes for subscription services.

15. The digital radio broadcast system of claim 9, wherein the UFID frame includes data identifying the first item and another item of interest, and a Uniform Resource Locator (URL) address for obtaining information about the first item and the another item of interest.

* * * * *